United States Patent [19]

Ohbayashi et al.

[11] Patent Number: 4,818,671

[45] Date of Patent: Apr. 4, 1989

[54] RAPIDLY PROCESSABLE SILVER HALIDE COLOR PHOTOSENSITIVE MATERIAL

[75] Inventors: Keiji Ohbayashi; Mitsuhiro Okumura; Takaaki Kojima; Shigeo Tanaka, all of Hino, Japan

[73] Assignee: Konishiroku Photo Industry Co., Ltd., Tokyo, Japan

[21] Appl. No.: 79,224

[22] Filed: Jul. 29, 1987

[30] Foreign Application Priority Data

| | | | |
|---|---|---|---|
| Jul. 31, 1986 | [JP] | Japan | 61-180643 |
| Aug. 13, 1986 | [JP] | Japan | 61-189925 |
| Dec. 18, 1986 | [JP] | Japan | 61-300107 |

[51] Int. Cl.[4] ..... G03C 17/26; G03C 1/16; G03C 1/08; G03C 7/36

[52] U.S. Cl. ..... 430/550; 430/575; 430/566; 430/603; 430/605

[58] Field of Search ..... 430/550, 583, 575, 603, 430/605, 566

[56] References Cited

U.S. PATENT DOCUMENTS

| | | | |
|---|---|---|---|
| 2,624,361 | 6/1953 | Damschroder et al. | 430/605 |
| 3,128,185 | 4/1964 | Goffe | 430/605 |
| 3,847,613 | 11/1974 | Sakazume et al. | 430/583 |
| 3,915,715 | 10/1975 | Millikan et al. | 430/605 |
| 4,469,785 | 4/1984 | Tanaka et al. | 430/550 |

*Primary Examiner*—Richard L. Schilling

*Attorney, Agent, or Firm*—Jordan B. Bierman

[57] ABSTRACT

A silver halide color photographic material improved in sensitivity, gradiation and maximum density when the material is treated with a rapid processing. The silver halide color photographic material comprises a support and photograhic component layers including at least one silver halide emulsion layer comprising (a) silver halide grains comprising not less than 80 mol % of silver chloride, (b) a gold compound in an amount of from $5\times10^{-7}$ to $5\times10^{-3}$ mol per mol of silver halide contained in said silver halide emulsion layer, (c) a sulfur sensitizer and (d) a spectral sensitizing dye represented by the following general formula [I]:

General formula [I]

wherein $X_1$, $X_2$, $X_3$ and $X_4$ are a hydrogen atom, a halogen atom, an alkyl group, an alkoxy group, an aryl group or a hydroxy group, respectively; $R_1$ and $R_2$ are an alkyl group, respective;y $X^{\ominus}$ is a counter anion and n is 0 or 1.

21 Claims, No Drawings

RAPIDLY PROCESSABLE SILVER HALIDE COLOR PHOTOSENSITIVE MATERIAL

FIELD OF THE INVENTION

The present invention relates to a silver halide color photosensitive material and, more particularly, to a rapidly processable silver halide color photosensitive material having a silver halide emulsion layer composed principally of silver chloride and which is able to produce a satisfactory dye image when rapidly processed.

BACKGROUND OF THE INVENTION

Normally, according to a dye image producing method in which a silver halide color photosensitive material is used, after an image-like exposure is effected, an oxidized p-phenilenediamine type color developing agent is caused to react with a dye forming coupler, whereby a dye image is produced. In such method, a color reproduction technique based on a subtractive color process is usually applied so that dye images in cyan, magenta, and yellow are formed on corresponding photosensitive layers in complementary relation to the three colors of red, green, and blue respectively. Recently, in order to shorten the development time required in connection with the formation of such dye images, it has become a usual practice to employ high-temperature development techniques and reduce the number of processing stops required. In order that the development time may be shortened through high temperature development in particular, it is very important to increase the rate of development in the process of color developing. The rate of development in the process of color development is subject to the effects of two sources. One of the sources is the silver halide color photosensitive material used and the other is the color developing solution used.

With the former it has been found that the particle shape and size in and the composition of the photosensitive silver halide emulsion used, in particular, have considerable bearing on the rate of development, while with the latter it has been found that the rate of development is likely to be influenced by the conditions of the color developing solution and, more particularly, by the type of the development restrainer used, and that grains of a high silver chloride in particular exhibit a remarkably high development rate under specific conditions, for example, such that bromide ions conventionally used for color development are not contained in the color developing solution.

In a photosensitive material for use as a color paper, a blue-sensitive emulsion layer is normally present as the lowermost layer, and therefore the emulsion layer is required to contain silver halide grains which show high sensitivity and a high rate of development. As one type of such technique for increasing the rate of development there is known a method in which a combination of a silver halide and a low-bromide silver is used, as disclosed in Japanese Published Unexamined Patent Application No. 58-184142 and Japanese Published Examined Patent Application No. 56-18939. However, with such method, wherein the silver chloride content of the emulsion layer is increased, the difficulty is that the photosensitivity is inevitably lowered. Such difficulty is attributable to the fact that pure silver chloride absorbs almost no visible light by nature. As attempts directed toward overcoming this difficulty there have been known methods using a combination of such spectral sensitizing dyes as mentioned in Japanese Published Unexamined Patent Application Nos. 58-91444, 58-95339, and 58-107532, or of such spectral sensitizing dyes having different wave lengths as mentioned in Japanese Published Unexamined Patent Application Nos. 58-95340, 58-106538, and 58-107531. However, no mention is made in these publications as to changes in gradation due to the use of a high silver chloride in combination with such dyes. As such, these combinations have not been successful for use in a color photosensitive material, or more particularly for use in a color paper.

It has also been found that the use of a spectral sensitizing dye in the form of a cyanine dye having two benzothiazole rings in a molecule cna enhance spectral sensitization in the visible light range, and more particularly in the light range of 430 nm–480 nm, thereby providing sufficient sensitivity even where a high-purity silver chloride is used.

In this case, however, the difficulty is that if the high-purity silver chloride is used in combination with such spectral sensitizing dye, a downward change in gradation will take place where development is effected with a color developing solution using p-phenylenediamine of the type which is normally used for the purpose of development, it being thus unable to obtain satisfactory color reproduction. Another difficulty is that where a developing solution having little or no bromide content is used with a view to increasing the rate of development, far much greater deterioration in gradation will result.

Recently, in order to minimize possible pollution loads arising from the processing of silver-halide photosensitive materials, there has been a strong demand for elimination from any color developing solution of benzyl alcohol, a coupling improver. If such demand is considered in conjunction with aforesaid color developing solution having no bromide ion content, that is, if a color developing solution containing neither bromide nor benzylalcohol is used, it has been found, a photosensitive material using such spectral sensitizing dye and such high-purity silver chloride grains will not only show an excessively decreasing gradation, but also will excessively enhance reduction in maximum photodensity.

SUMMARY OF THE INVENTION

This invention is intended to overcome aforesaid difficulties, and has as its primary object the provision of a silver halide color photosensitive material which has a high silver chloride content and yet is able to prevent the development of any excessive decrease in gradation with a dye image produced from the material, and which, even when a color developing solution having no benzyl alcohol content is used, can assure a sufficient maxim density and formation of a satisfactory dye image at a very high rate of development.

The above objects of the invention are achieved by a silver halide color photographic light-sensitive material comprising a support having thereon photographic component layers including at least one silver halide emulsion layer comprising (a) silver halide grains comprising not less than 80 mol% of silver chloride, (b) a gold compound in an amount of from $5\times10^{-7}$ to $5\times10^{-3}$ mol per mol of silver halide contained in said silver halide emulsion layer, (c) a sulfur sensitizer and (d) a spectral sensitizing dye represented by the following general formul [I] in an amount of from $5\times10^{-6}$ to $3\times10^{-3}$ mol per mol of silver halide containing said silver halide emulsion layer:

General formula [I]

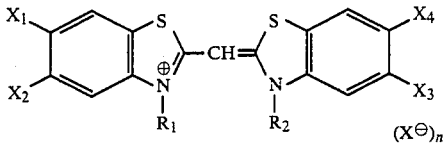

wherein $X_1$, $X_2$, $X_3$ and $X_4$ are a hydrogen atom, a halogen atom, an alkyl group, an alkoxy group, an aryl group or a hydroxy group, respectively; $R_1$ and $R_2$ are an alkyl group, respectively; $X\ominus$ is a counter anion and n is 0 or 1.

DETAILED DESCRIPTION OF THE INVENTION

The above-mentioned silver halide grains containing not less than 80 mol% of silver chloride, the gold compound, sulfur sensitizer, and the compound expressed by the general formula [I] are all contained in one silver-halide emulsion layer (which is hereinafter sometimes referred to as the "silver halide emulsion layer of the invention"), if the photosensitive material in accordance with the invention has only one such emulsion layer. If the photosensitive material has a plurality of silver-halide emulsion layers, at least one of the layers should be the silver halide emulsion layer of the invention. Preferably, a blue sensitive emulsion layer which is usually formed as the loweremost layer (i.e., the layer nearest to the base) has aforesaid compositional features of the invention so that it constitutes the silver halide emulsion layer of the invention. More preferably, a yellow coupler contained in the blue sensitive emulsion layer is selected from the couplers represented by the general formula [Y] mentioned hereinafter.

If the photosensitive material has a plurality of silver halide emulsion layers, needless to say, some of the layers need not be of same compositional feature as the silver halide emulsion layer of the invention.

Specific compositional features of the invention will now be described.

Gold compounds useful for incorporation in the silver halide emulsion layer include, for example, aurate chloride, sodium chloroaurate, and potassium thiosulfoaurate (but without limitation thereto). The proportion of such gold compound used is $5\times10^{-7}$–$5\times10^{-3}$ mol per mol of the silver halide, preferably $1.0\times10^{-6}$–$1\times10^{-4}$ mol. More preferably, it is $1.0\times10^{-6}$–$4\times10^{-5}$, most preferably $1.0\times10^{-6}$–$9\times10^{-6}$.

Such gold compound may be added at any stage in the process of silver halide emulsion preparation, but preferably between the end of the stage of silver halide formation and the end of the stage of chemical sensitization. Alternatively, it may be added after the end of the stage of chemical ripening, or more particularly after the addition of a compound known as an antifoggant or stabilizer and before the stage of silver halide emulsion coating. In other words, the gold compound in the invention can have its effect even if it is added at any point of time other than a usual point of time for gold sensitization, that is, at any position at which it cannot exhibit its sensitizing effect.

Sulfur sensitizers useful for incorporation in the silver halide emulsion layer of the invention include, for example, sodium thiosulfate, and thiourea derivatives such as diphenyl thiourea and allyl thiourea, but without limitation thereto. A sulfur sensitizer may be added in such quantity as is sufficient to sensitize the silver halide. There is no particular limitation on such quantity, but as a yardstick it may be mentioned that in the case where sodium thiosulfate is used, it is added preferably at the rate of $1\times10^{-7}$–$1\times10^{-5}$, more preferably at the rate of $2\times10^{-6}$–$8\times10^{-6}$.

Nextly, the compound expressed by the general formula [I] that is used in the silver halide emulsion layer of the invention will be explained.

General formula [I]

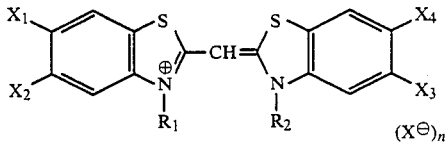

In the spectral sensitizing dye of the general formula [I], $X_1$, $X_2$, $X_3$, and $X_4$ represent hydrogen or halogen atoms, or alkyl, alkoxy, aryl, or hydroxyl groups. More specifically, halogen atoms include, for example, chlorine atoms. For alkyl groups may be mentioned methyl or ethyl groups having 1 to 6 carbon atoms, for example. For alkoxy groups may be mentioned methoxy or ethoxy groups having 1 to 6 carbon atoms. Preferably, at least one of $X_1$, $X_2$, $X_3$ and $X_4$ is chlorine atom, and more preferably the compound two of them are chlorine atoms.

$R_1$ and $R_2$ represent alkyl groups including those having a substituent group. Preferably, $R_1$ and $R_2$ are unsubstituted alkyl groups, or carboxyl- or sulfo-substituted alkyl groups, more preferably carboxyl- or sulfo-substituted alkyl groups. Most preferably, they are sulfo-alkyl or carboxy-alkyl groups having 1 to 4 carbon stoms.

$R_1$, $R_2$ may be identical with or different from each other. Preferably, either of them is a carboxyl-substituted alkyl group having 1 to 4 carbon atoms.

$X\ominus$ represents a counter anion. Though not definitive, it includes halogen ion (such as $B^-$ or $I^-$).

n represents 0 to 1.

Spectral sensitizing dyes expressed by the general formula [I] are individually known compounds, which may easily be synthesized by reference to various publications, such as for example the respective specifications of British Patent No. 660408, U.S. Pat. No. 3149105, and Japanese Published Unexamined Patent Application No. 50-4127, as well as F. M. Hamer, "The Cyanine Dyes and Related Compounds", Interscience Publishers, New York, 1969, pp 32–76.

Spectral sensitizing dyes expressed by the general formula [I] that are used in the present invention are shown by way of example in Table 1 below; it is understood, however, that compounds of the kind useful for the purpose of the invention are not limited to those enumerated therein.

TABLE 1

General formula [I]

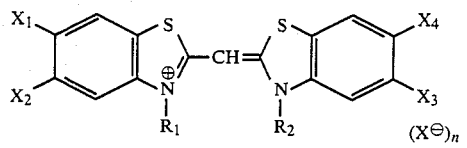

| Compound No. | $X_1$ | $X_2$ | $X_3$ | $X_4$ | $R_1$ | $R_2$ | n | $X^{\ominus}$ |
|---|---|---|---|---|---|---|---|---|
| I-1 | H | —Cl | —Cl | H | $(CH_2)_3SO_3^{\ominus}$ | $(CH_2)_3SO_3H.NEt_3$ | 0 | |
| I-2 | H | $CH_3O$— | —$OCH_3$ | H | $(CH_2)_3SO_3^{\ominus}$ | $(CH_2)_3SO_3Na$ | 0 | |
| I-3 | H | —$CH_3$ | —$CH_3$ | H | $(CH_2)_3SO_3^{\ominus}$ | $(CH_2)_3SO_3H.NEt_2$ | 0 | |
| I-4 | H | H | —$CH_3$ | —$CH_3$ | $(CH_2)_3SO_3^{\ominus}$ | $(CH_2)_2SO_3H.NEt_3$ | 0 | |
| I-5 | H | —Cl | —Cl | H | $(CH_2)_3SO_3^{\ominus}$ | $(CH_2)_2SO_3H$ | 0 | |
| I-6 | H | —Cl | —$CH_3$ | H | $(CH_2)_2SO_3^{\ominus}$ | $(CH_2)_3SO_3H$ | 0 | |
| I-7 | H | H | H | H | $(CH_2)_2SO_3^{\ominus}$ | $(CH_2)_2SO_3H$ | 0 | |
| I-8 | H | —Cl | —Cl | H | $(CH_2)_2SO_3^{\ominus}$ | $CH_2COOH$ | 0 | |
| I-9 | H | —$CH_3$ | —Cl | H | $(CH_2)_2SO_3^{\ominus}$ | $(CH_2)_2SO_3Na$ | 0 | |
| I-10 | H | —Cl | —Cl | H | $(CH_2)_2COO^{\ominus}$ | $(CH_2)_2COOH$ | 0 | |
| I-11 | H | H | H | H | $(CH_2)CHSO_3^{\ominus}$ ($CH_3$) | $CH_2$—CH=$CH_2$ | 0 | |
| I-12 | H | —Cl | —Cl | H | $(CH_2)_3SO_3^{\ominus}$ | $CH_2COOH$ | 0 | |
| I-13 | H | —Cl | —$CH_3$ | H | $CH_2)_3SO_3^{\ominus}$ | $CH_2COOH$ | 0 | |
| I-14 | H | —Cl | —$CH_3$ | H | $(CH_2)_3COO^{\ominus}$ | $(CH_2)_2SO_3H$ | 0 | |
| I-15 | H | $CH_3O$— | H | H | $(CH_2)_4SO_3^{\ominus}$ | $(CH_2)_2COOH$ | 0 | |
| I-16 | —$CH_3$ | H | H | H | $(CH_2)_3COO^{\ominus}$ | $CH_2COOH$ | 0 | |
| I-17 | H | H | H | H | $(CH_2)_3SO_3^{\ominus}$ | $(CH_2)_2SO_3Na$ | 0 | |
| I-18 | H | H | H | H | $C_2H_5$ | $CH_2COOH$ | 1 | $Br^{\ominus}$ |

TABLE 1-continued

General formula [I]

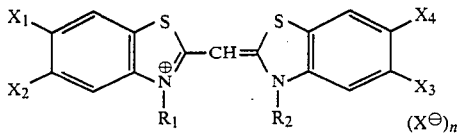

| Compound No. | $X_1$ | $X_2$ | $X_3$ | $X_4$ | $R_1$ | $R_2$ | n | $X^{\ominus}$ |
|---|---|---|---|---|---|---|---|---|
| I-19 | H | H | H | H | $C_2H_5$ | $(CH_2)_2SO_3H$ | 1 | $Br^{\ominus}$ |
| I-20 | H | H | Cl | H | $-(CH_2)_2SO_3^-$ | $-(CH_2)_2SO_3H$ | 0 | |
| I-21 | H | Cl | Cl | H | $-(CH_2)_2SO_3^-$ | $-(CH_2)_2SO_3H$ | 0 | |
| I-22 | H | Cl | Cl | H | $-(CH_2)_3SO_3^-$ | $-(CH_2)_3SO_3H$ | 0 | |
| I-23 | H | Cl | Cl | H | $-(CH_2)_4SO_3-$ | $-(CH_2)_4SO_3H$ | 0 | |
| I-24 | H | Cl | Cl | H | $-(CH_2)_4SO_3^-$ | $-(CH_2)_3SO_3H$ | 0 | |
| I-25 | H | Cl | Cl | H | $-CH_2CH(SO_3^-)-CH_3$ | $-(CH_2)_3SO_3H$ | 0 | |
| I-26 | H | Cl | Cl | H | $-CH_2CH_2COO^-$ | $-(CH_2)_3SO_3H$ | 0 | |
| I-27 | H | Cl | Cl | H | $-CH_2COO^-$ | $-(CH_2)_3SO_3H$ | 0 | |
| I-28 | H | Cl | Cl | H | $-CH_2COO^-$ | $-(CH_2)_4SO_3H$ | 0 | |
| I-29 | H | Cl | Cl | H | $-CH_2CH_2NHSO_2CH_3$ | $-(CH_2)_2SO_3H$ | 1 | $Br^-$ |
| I-30 | H | Cl | Cl | H | $-CH_2COO^-$ | $-(CH_2)_3OH$ | 0 | |
| I-31 | H | Cl | Cl | H | $-(CH_2)_3SO_3^-$ | $-(CH_2)_3OH$ | 0 | |
| I-32 | H | Cl | $CH_3$ | H | $-(CH_2)_3SO_3^-$ | $-(CH_2)_3SO_3H$ | 0 | |
| I-33 | H | Cl | $CH_3$ | H | $-(CH_2)_3SO_3^-$ | $-(CH_2)_2SO_3H$ | 0 | |
| I-34 | H | Cl | $CH_3$ | H | $-CH_2COO^-$ | $-(CH_2)_3SO_3H$ | 0 | |
| I-35 | H | Cl | $CH_3$ | H | $-CH_2COO^-$ | $-(CH_2)_4SO_3H$ | 0 | |
| I-36 | H | Cl | $CH_3$ | H | $-(CH_2)_2SO_3^-$ | $-(CH_2)_3OH$ | 0 | |
| I-37 | H | Cl | $CH_3$ | H | $-(CH_2)_2SO_3^-$ | $-(CH_2)_2NHSO_2CH_3$ | 0 | |
| I-38 | H | Cl | $CH_3$ | $CH_3$ | $-(CH_2)_3SO_3^-$ | $-(CH_2)_2SO_3H$ | 0 | |
| I-39 | H | Cl | $CH_3$ | $CH_3$ | $-(CH_2)_2SO_3^-$ | $-(CH_2)_3SO_3H$ | 0 | |
| I-40 | H | Cl | $CH_3$ | $CH_3$ | $-(CH_2)_3SO_3^-$ | $-CH_2COOH$ | 0 | |
| I-41 | H | Cl | $CH_3$ | $CH_3$ | $-CH_2COO^-$ | $-(CH_2)_3SO_3H$ | 0 | |
| I-42 | H | $CH_3$ | $CH_3$ | H | $-(CH_2)_3SO_3^-$ | $-(CH_2)_3SO_3H$ | 0 | |
| I-43 | H | $CH_3$ | $CH_3$ | H | $-(CH_2)_3SO_3^-$ | $-CH_2COOH$ | 0 | |
| I-44 | H | $CH_3O$ | $CH_3$ | H | $-(CH_2)_3SO_3^-$ | $-(CH_2)_3SO_3H$ | 0 | |
| I-45 | H | $CH_3O$ | $CH_3$ | H | $-(CH_2)_3SO_3^-$ | $-CH_2COOH$ | 0 | |
| I-46 | H | $CH_3O$ | $CH_3$ | H | $-CH_2COO^-$ | $-(CH_2)_3SO_3H$ | 0 | |
| I-47 | H | $CH_3O$ | H | H | $-CH_2COO^-$ | $-(CH_2)_3SO_3H$ | 0 | |
| I-48 | H | $CH_3O$ | H | H | $-(CH_2)_3SO_3^-$ | $-(CH_2)_3SO_3H$ | 0 | |
| I-49 | H | $CH_3$ | $CH_3$ | H | $-C_2H_5$ | $-C_2H_5$ | 1 | $I^-$ |
| I-50 | H | Cl | Cl | H | $-C_2H_5$ | $-C_2H_5$ | 1 | $I^-$ |

In Table 1 above, $NEt_3$ represents

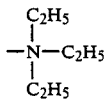

In the present invention, the proportion of any such spectral sensitizing dye as exemplified above, relative to silver halide, is $5\times10^{-6}$–$5\times10^{-2}$ mol/AgX mol. Preferably, the proportion is $1\times10^{-5}$–$1\times10^{-3}$ mol/AgX mol. Most preferably, it is $1\times10^{-4}$–$9\times10^{-4}$ mol/AgX mol.

In carrying out the present invention, such spectral sensitizing dye may be added to an emulsion of silver halide according to any relevant technique well known in the art.

For example, such sensitizing dye may be dispersed directly in the emulsion, or may be added to the emulsion in the form of an aqueous solution or a solution prepared by dissolving the dye in a water soluble solvent, such as pyridine, methyl alcohol, ethyl alcohol, methyl Cellosolve, or acetone (or a mixture of any such solvents), or in some other case, in the form of a solution of the dye diluted with water. Ultrasonic vibration may be advantageously used in connection with such dissolving work. For the purpose of such addition it is possible to use such a method as disclosed in U.S. Pat. No. 3,469,987, in which a sensitizing dye is dissolved in a volatile organic solvent and the resulting solution is dispersed in a hydrophilic colloid, the dispersion being added to the emulsion; or such other method as disclosed in Japanese Patent Publication No. 46-24185, in which a water insoluble dye is dispersed in a water soluble solvent without being dissolved, the dispersion being then added to the emulsion. Any such spectral sinsitizing dye may be added to the emulsion in the form of a dispersion by the acid dissolution-dispersion technique. Methods disclosed in U.S. Pat. Nos. 2,912,345, 3,342,605, 2,996,287, and 3,425,835 may also be employed in adding such dye to the emulsion.

Any one kind of spectral sinsitizing dye expressed by the general formula [I] may be used alone for the purpose of the invention, or two or more kinds of such dye may be used in combination. Where two or more kinds of such dye are used, they may be added either simultaneously or separately. If they are added separately, the sequence, timing, and intervals for such addition may be determined according to the intended object. If so desired, such dye may be used in combination with any sensitizing dye other than those expressed by the general formula [I].

The timing for addition of such specific spectral sensitizing dye for incorporation of same into the silver halide photosensitive emulsion layer is freely selected in the course of silver halide photosensitive emulsion preparation. Generally, the dye is added after the end of the first ripening stage and before the end of the second ripening stage, for example. During such period the sensitizing dye may be added in parts.

The silver halide emulsion used for formation of the silver halide emulsion layer of the invention may be of silver chlorobromide, silver iodochloride, or silver chloroiodobromide silver chloride, provided that it must be a high chloro silver halide emulsion containing not less than 80 mol% of silver chloride. Preferably, the emulsion contains silver chloride in an amount of 95 to 100 mol% more preferably, of 99.0 to 99.9 mol%. The emulsion may contain silver iodide but its content of such silver iodide is preferably not more than 1 mol%, more preperably not more than 0.5 mol%. Most preferably, the emulsion contains no silver iodide. The silver bromide content of the emulsion is preferably less than 5 mol%, or it may be even 0 mol%.

In the present invention, the silver halide grains containing not less than 80 mol% of silver chloride should preferably constitute not less than 80% by weight, more preferably 100% by weight, of the entire silver halide grain content of the silver halide emulsion layer in which said silver halide grains are contained. Further, the mean silver chloride content of the emulsion layer in which such silver halide grains are contained should preferably be not less than 80 mol%, more preferably not less than 85 mol%.

That the silver halide grains contained in the silver halide emulsion layer should preferably have a mean silver halide content of not less than 80 mol% means that the molar ratio of silver shloride to the entire emulsion layer is not less than 80 mol%. It is permissible that in the emulsion layer there is present a partial deviation from said compositional feature, or that there is contained some other substance (such as for example pure silver bromide) than the one represented by said molar ratio.

When the photosensitive material in accordance with the invention has a plurality of silver halide emulsion layers, as already mentioned, some of the emulsion layers may be of a composition different from that of the silver halide emulsion layer of the invention, and such other emulsion layer need not be of a high silver chlorohalide composition. However, the emulsion layers, as a whole, of the photosensitive material is preferably have a mean silver halide content of not less than 80 mol%, and more preferably all the emulsion layers contains silver halide grains having a silver chloride content of not less than 80 mol%. It is particularly desirable that the all layer average, preferably all the layers have a silver chloride content of not less than 95 mol%.

Silver halide grains used in the color photosensitive material in accordance with the invention, namely, silver halide grains used in the silver halide emulsion layer and other emulsion layer or layers which may be formed as required (hereinafter referred to as "silver halide grains used in the invention") preferably have a mean grain size of less than 5 μm, more preferably less than 3 μm, and most preferably less than 1 μm, in termes of mean grain diameter as defined by the following equation:

$$r = \frac{\Sigma n_i r_i}{\Sigma n_i}$$

in which $\bar{r}$ represents mean grain diameter; $r_i$ represents individual grain diameter; and $n_i$ represents the number of particles having individual grain diameter $r_i$. It is noted that if the silver halide grains are of a cubic shape, the length of one side of the cube is taken as the diameter of each individual grain; and if the grains are spherical or of any other shape than cubic, the length of one side of a cube having same volume is taken as the diameter of each individual grain.

The grain diameter distribution of the silver halide grains used in the invention may be of a polydisperse pattern or of a monodisperse pattern, but it is desirable that the silver halide emulsion should be monodisperse. In this connection it is noted that the term monodisperse herein means that the coefficient of variation of the grain diameter distribution of silver halide grains contained in the emulsion is not more than 22%, preferably not more than 15%. The coefficient of variation indicates the spread of grain diameter distribution and is defined by the following equation:

$$\text{Variation coef} = \frac{\text{Std deviation of grain dia distr}}{\text{Mean particle dia}} \times 100\%$$

$$\text{Std deviation of grain dia distr} = \sqrt{\frac{\Sigma (r_i - r)^2 n_i}{\Sigma n_i}}$$

Such grain diameter can be measured by various methods conventionally used in the art for the above mentioned purpose. Typical of such method is the one described in Lapland "Method of Grain Diameter Analysis", A.S.T.M. Symposium on Light Microscopy, 1955, pp 99–122. Another typical method is described in "The Theory of Photographic Process", Mies and James, 3rd ed., The Macmillan Press Ltd (1966), Chap. 2.

In the present invention, the term "silver halide emulsion" refers to an emulsion constituting the silver halide emulsion layer of the invention and any emulsion constituting any other emulsion layer which may be formed as required. Silver halide grains used for this purpose may be produced by the acid process, the neutral process, or the ammonia process. Such grains may be grown all at once, or seed grains are first prepared and they are caused to grow for growing. The technique for seed grain preparation may be same as or different from the technique for grain growing.

The silver halide emulsion may be prepared by mixing an ion halide and a silver ion at same time, or by mixing the one tinto a liquid in which the other is present. Alternatinely, the ion halide and the silver ion are added together gradually into a mixing vessel while the pH and pAg in the vessel are properly controlled with attention paid to the critical rate of growth of silver halide crystals so that they are grown into a silver halide emulsion.

Thus, it is possible to obtain monodispersed silver halide grains having good regularity in crystal form and good uniformity in grain diameter. After their growth, the grains may be varied in their halogen composition by employing by some conversion technique.

For the purpose of preparing the silver halide emulsion, any apparatus known as such in the art of photography can be employed. More particularly, apparatuses utilizing any one of the following methods can be advantageously employed. One method is such that an aqueous silver halide solution and an aqueous solution of salt halide are introduced through nozzles immersed in a hydrophilic colloidal solution in a mixture pot. Another method is such that the concentration of an addition liquid is successively varied. Another method is such that excess quantities of soluble salt and water in a hydrophilic colloidal solution in the mixing vessel are removed by ultra filtration or otherwise in order to prevent interparticle intervals from becoming larger.

In the process of manufacturing the silver halide emulsion of the invention, the size and shape of silver halide grains, their grain size distribution, and the rate or their growth can be suitably controlled by using a silver halide solvent as required.

Silver halide grains used in the silver halide emulsion of the invention, in the process of grain formation thereof and/or in the process of their growth, may be added with a metallic ion through the use of one kind of material selected from the group consisting of cadmium salt, zinc salt, lead salt, thallium salt, iridium salt (complex salt including it), rhodium salt (complex salt including it), and ferric salt (complex salt including it) so that such metallic element is contained in the grains in their interior and/or on their surface, or may be caused to have a reduction sensitivity speck in their interior and/or on their surface by being placed in a reductive atmosphere.

The silver halide emulsion of the invention may be cleared of all unnecessary soluble salts at the end of the stage of silver halide grain growth, or may be allowed to contain such salts as they are. For the purpose of removing such salts, the method described in "Research Disclosure" No. 17643 may be employed.

Silver halide grains used in the silver halide emulsion of the invention may be either those having a uniform silver halide distribution within their interior or core/-shell grains having silver halide compositions different between their interior and their surface.

Silver halide grains in a silver halide emulsion having a high chloride content are likely to have a cubic shape. However, by allowing the presence of various different compounds during the stage of grain formation, it is possible to prepare such regular crystal shape as cube, octahedron, or quaterdecahedron. In another permissible crystal form, they may have such an irregular configuration as spherical or lamellar. These grains may have any desired side-to-side ratio. Also, they may have a composite form of these crystalline shapes, or they may be a mixture of grains having different crystalline shapes. In the present invention, however, it is preferable to use cubic grains.

The silver halide emulsion of the invention may be a mixture of two or more kinds of silver halide emulsions which have been prepared separately.

The silver halide color photographic lightsensitive material of the invention may preferably contain a black- and white developing agent in one of the photographic structural layer. The score of black- and white developing agents may be used in the invention is not specifically limited and include those widely used in the photographic art. Specifically, however, the preferred agents include triazole-3pyrazolidone compounds, polyhydroxybenzene compounds and N-alkyl-p-aminophenol compounds.

The typical examples of black-and-white developing agents favorably used according to the invention are as follows. However, the scope of the invention is not limited only to these examples.

D-1 1-Phenyl-3-pyrazolidone
D-2 1-Tolyl-3-pyrazolidone
D-3 4-Methyl-1-phenyl-3-pyrazolidone
D-4 4-Methyl-4-hydroxylmethyl-1-phenyl-3-pyrazolidone
D-5 4,4-Dimethyl-1-phenyl-3-pyrazolidone
D-6 4-Methyl-4-hydroxylethyl-1-phenyl-3-pyrazolidone
D-7 4-Methyl-4-acetoxymethyl-1-phenyl-3-pyrazolidone
D-8 4-Methyl-4-butanoyloxymethy-1-phenyl-3-pyrazolidone
D-9 4-Methyl-4-hydroxymethyl-1-tolyl-3-pyrazolidone
D-10 4-Methyl-4-hydroxymethyl-1-phenyl-5-phenyl-3-pyrazolidone
D-11 1,4-Dihydroxybenzene
D-12 1,2-Dihydroxybenzene
D-13 2-Chloro-1,4-dihydroxybenzene
D-14 2-Methyl-1,4-dihydroxybenzene
D-15 2,5-Dimethyl-1,4-dihydroxybenzene
D-16 Sodium 1,4-Dihydroxybenzene-5-sulfonate
D-17 Sodium 1,4-Dihydroxybenzene-5-carboxylate
D-18 Sodium 1,5-Dihydroxybenzene-2,5-dicarboxylate
D-19 Sodium 1,2-Dihydroxybenzene-4-sulfonate
D-20 Sodium 1,2-Dihydroxybenzene-4-carboxylate
D-21 Sodium 1,2-Dihydroxybenzene-3,5-disulfonate
D-22 Sodium 1,2-Dihydroxybenzene-3,5-dicarboxylate
D-23 N-Methyl-P-aminophenol
D-24 N-Ethyl-P-aminophenol.

To incorporate the black-and-white developing agent may be employed in the invention into the photographic structural layers the agent may be added unchangedly, or after being dissolved in an appropriate solvent such as water or alcohol (which does not exert adverse effects on the light-sensitive material) at an appropriate proportion, into the coating solutions to form the layers. The black-and-white developing agent may be incorporated into the layers after being dissolved in high boiling and/or low boiling organic solvents and then dispersing and emulsifying the solvents into water.

The examples of high boiling solvent, being organic solvents having boiling points higher than 150° C., are as follows: phenol derivatives, alkyl phthalates, phosphates, citrates, benzoates, alkylamides, fatty acyl esters, and trimesyl esters, each of which not reacting with the oxidized product of developing agent.

The mentioned organic solvents having high boiling points are those disclosed in the following patents: U.S. Pat. No. 2,332,027, No. 2,533,514, No. 2,835,579, No. 3,387,134, No. 2,353,262, No. 2,852,383, No. 3,554,755, No. 3,676,137, No. 3,676,142, No. 3,700,454, No. 3,748,141, No. 3,779,765 and No. 3,837,863; British Pat. No. 958,441 and No. 1,333,753; West German OLS Pat. No. 2,538,889; Japanese Patent O.P.I. Publications No. 1031/1972, No. 90523/1974, No. 23823/1975, No. 26037/1976, No. 27921/1976, No. 27922/1976, No. 26035/1976, No. 26036/1976, No. 62632/1975, No. 1520/1978, No. 1521/1978, No. 15127/1978, No. 119921/1979, No. 119922/1979, No. 25057/1980, No. 36869/1980, No. 19049/1981 and No. 81836/1981, and;

Japanese patent Examined Publications No. 29060/1973.

The low boiling or water soluble organic solvent which may be used together with or instead of the high boiling solvents may be those described in U.S. Pat. Nos. 2,801,171 and 2,949,360, and others. The examples of low boiling organic solvent substantially water-insoluble are as follows: ethyl acetate, propyl acetate, butyl acetate, butanol, chloroform, carbon tetrachloride, nitromethane, nitroethane, benzene and the like; water soluble organic solvents such as acetone, methyl isobutylketone, β-ethoxyethyl acetate, methoxy glycol acetate, methanol, ethanol, acetonitrile, dioxane, dimethylformamide, dimethylsulfoxide, hexamethylphosphoramide, diethylene glycol-monophenyl ether, phenoxylethanol and the like.

The timing of the addition of the black-and-white developing agent of the invention may be at any step of the manufacturing process, but generally, it is favorable that the agent be added into emulsion immediately before it is applied.

The black-and-white developing agent to be used in the invention may be a combination of more than two agents.

The black-and-white developing agent may be contained in any of the photographic component layers, however, it is advantageous to incorporate the agent into the silver halide emulsion layers or the adjacent layers thereof. The amount of the developing agent to be added depends on the type of the agent and the silver halide, but ordinarily, is 0.1–100 mg, or favorably, 0.5–10 mg per $m^2$.

The sensitizing dye represented by the general formula [I] of the invention and the black- and white developing agent may be contained in a same layer or in different layers.

The lightsensitive material of the invention may contain a dye-forming coupler being capable of, during color developing, forming a dye by coupling with the oxidized product of aromatic primary amine developing agent (such as p-phenylenediamine derivative, aminophenol derivative and the like).

Such couplers may be contained in any of emulsion layers composing the light-sensitive material. However, as mentioned previously, the yellow coupler should be favorably contained in the silver halide emulsion layer. As the yellow couplers to be used in the invention, those described in the following patents should be referred to; U.S. Pat. No. 2,186,849, No. 2,322,027, No. 2,728,658, No. 2,875,057, No. 3,265,506, No. 3,277,155, No. 3,408,194, No. 3,415,652, No. 3,447,928, No. 3,664,841, No. 3,770,446, No. 3,778,277, No. 3,849,140 and No. 3,894,875; British Pat. No. 778,089, No. 808,276, No. 875,476, No. 1,402,511, No. 1,421,126 and No. 1,513,832; Japanese Patent Examined Publication No. 13576/1974; Japanese Patent O.P.I. Publications No. 29432/1973, No. 66834/1973, No. 10736/1974, No. 122335/1974, No. 28834/1975, No. 132926/1975, No. 1338832/1975, No. 3631/1976, No. 17438/1976, No. 26038/1976, No. 26039/1976, No. 50734/1976, No. 53825/1976, No. 75521/1976, No. 89728/1976, No. 102636/1976, No. 107137/1976, No. 117031/1976, No. 122439/1976, No. 1443319/1976, No. 9529/1978, No. 82332/1978, No. 135625/1978, No. 145619/1978, No. 23528/1979, No. 48541/1979, No. 65035/1979, No. 133329/1979 and No. 598/1980; and others.

The examples of the particularly favorable yellow couplers include those represented by the general formulae below.

More specifically, the yellow couplers to be advantageously used in the color photographic lightsensitive material of the invention are divalent, non-diffusible yellow couplers represented by the following general formula [Y].

General formula [Y]

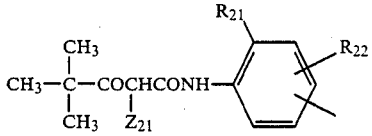

wherein $R_{21}$ is a halogen atom or an alkoxy group; $R_{22}$ is a $—NHCOR_{23}SO_2R_{24}$ group, a $—COOR_{24}$ group, a $—COOR_{23}COOR_{24}$ group, an $$—\underset{\underset{R_{25}}{|}}{NSO_2R_{24}}$$

group or an $$—\underset{\underset{R_{25}}{|}}{SO_2NR_{24}}$$

group in which $R_{23}$ is an alkylene group, $R_{24}$ is a ballast group and $R_{25}$ is an alkyl group, an aralkyl group or a hydrogen atom; and $Z_{21}$ is a group capable of being splitted off upon reaction with the oxydized product of a color developing agent.

The typical examples of divalent yellow couplers advantageously used in the invention are listed below.

[Example compounds]
(Y-1)
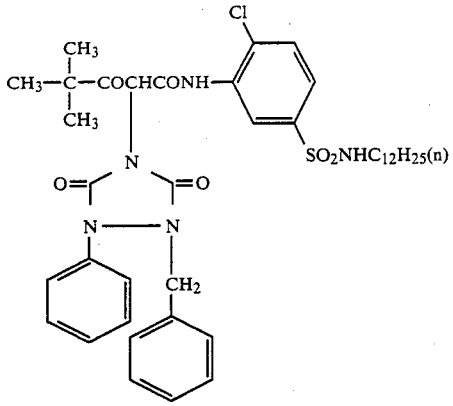
(Y-2)
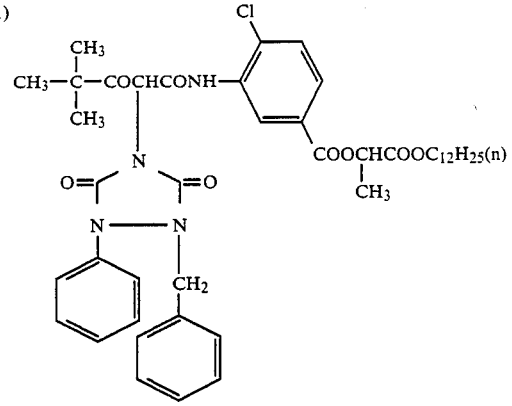
(Y-3)
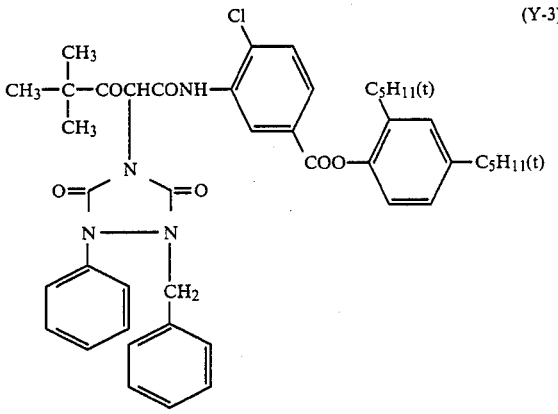
(Y-4)
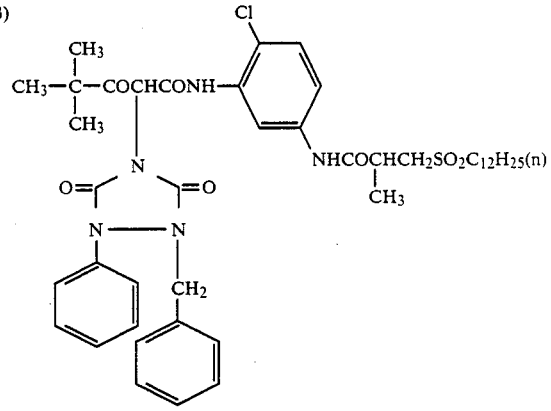
(Y-5)
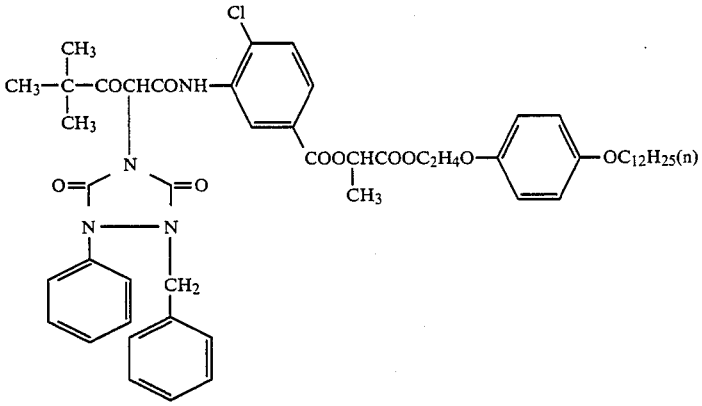
(Y-6)
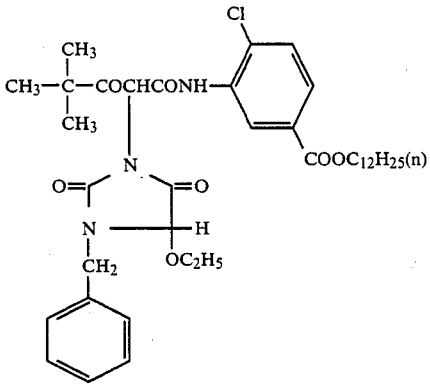
(Y-7)
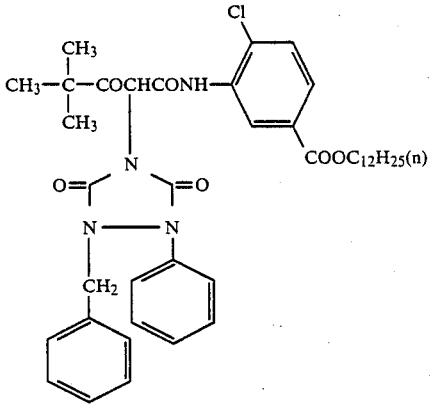

-continued
[Example compounds]
(Y-8)
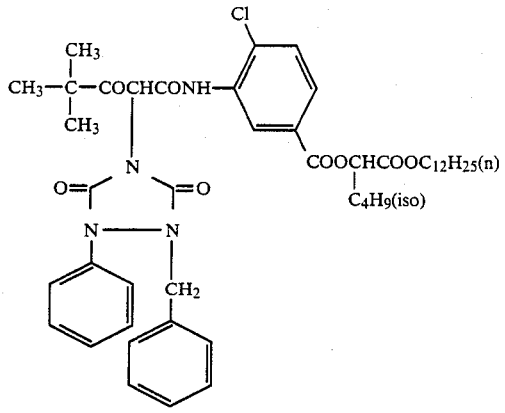
(Y-9)
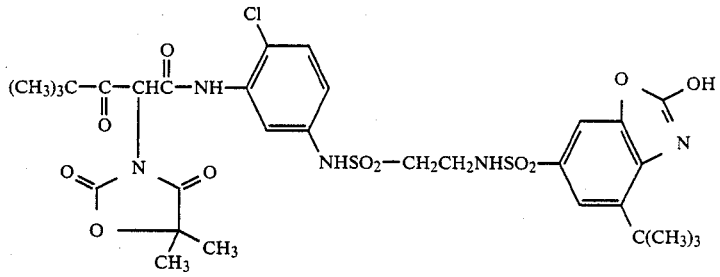
(Y-10)
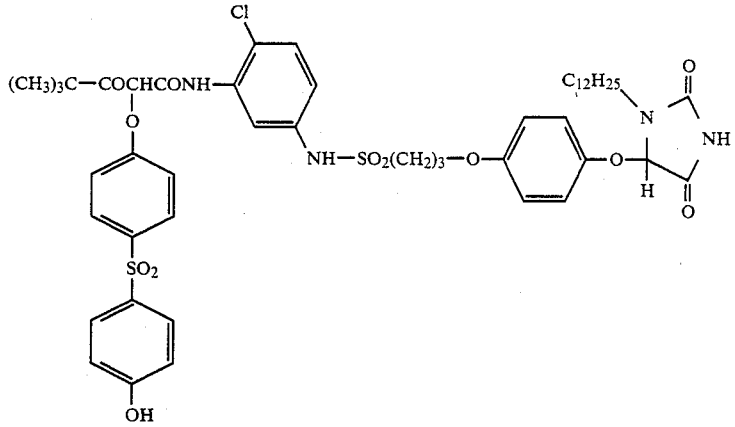
(Y-11)
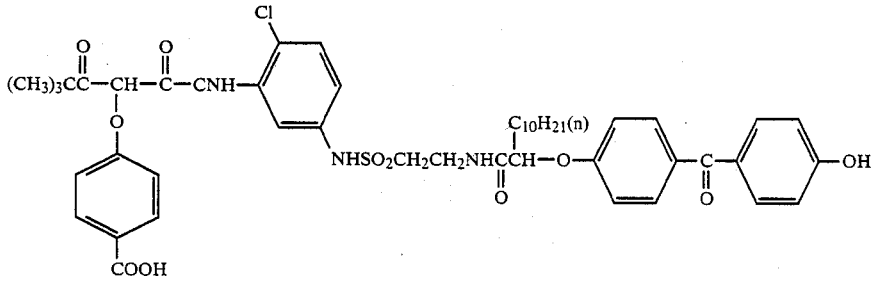

-continued
[Example compounds]
(Y-12)
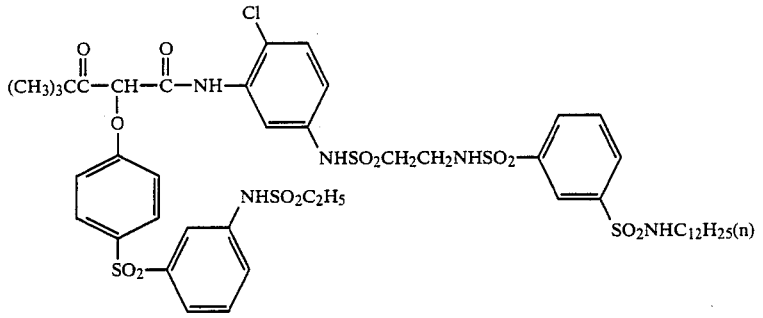
(Y-13)
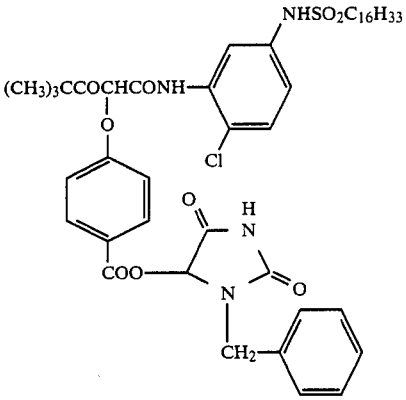
(Y-14)
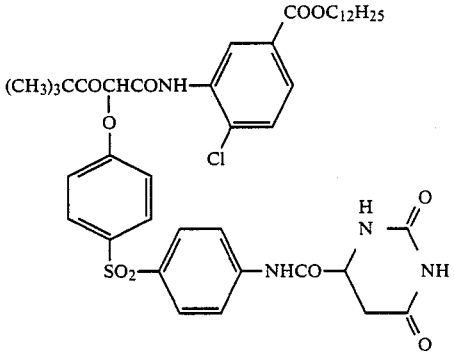
(Y-15)
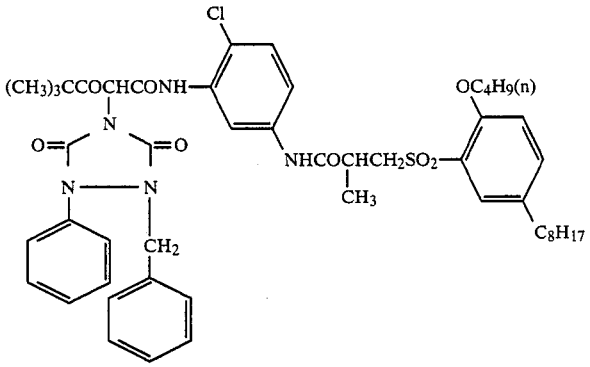
(Y-16)
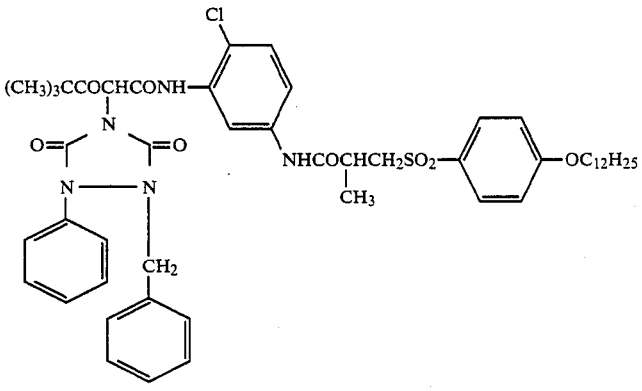

-continued
[Example compounds]
(Y-17)
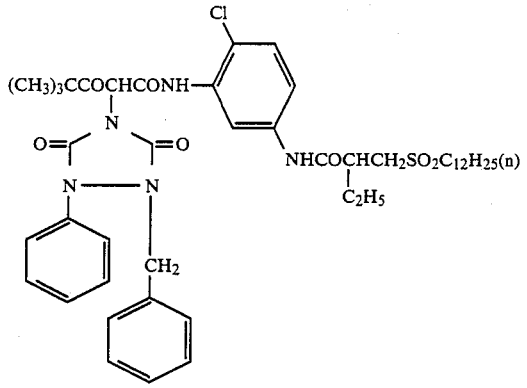
(Y-18)
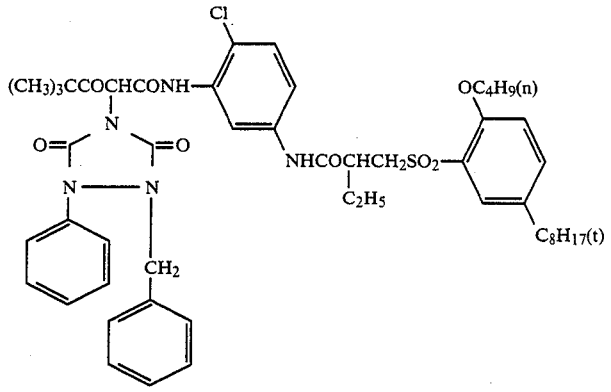
(Y-19)
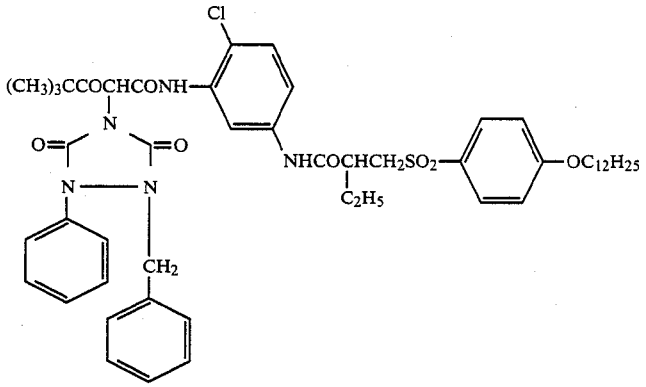
(Y-20)
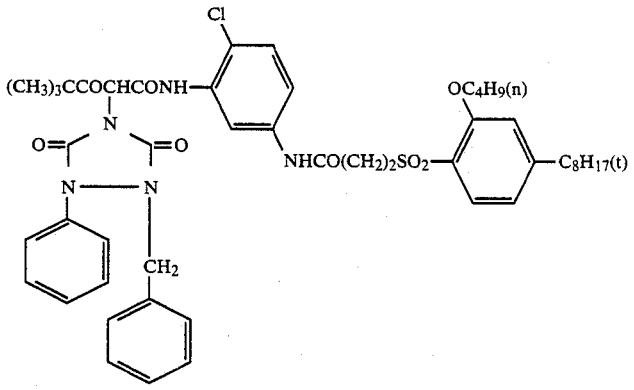

-continued
[Example compounds]
(Y-21)
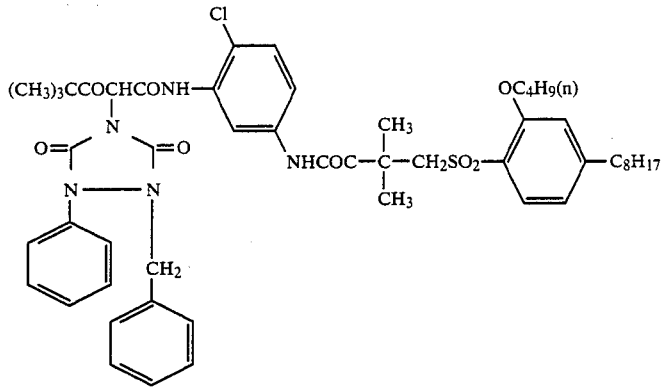
(Y-22)
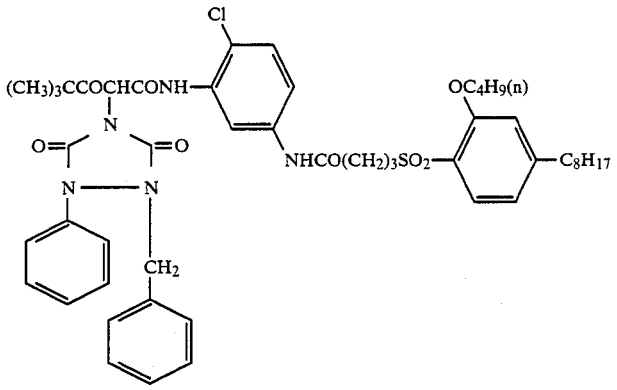
(Y-23)
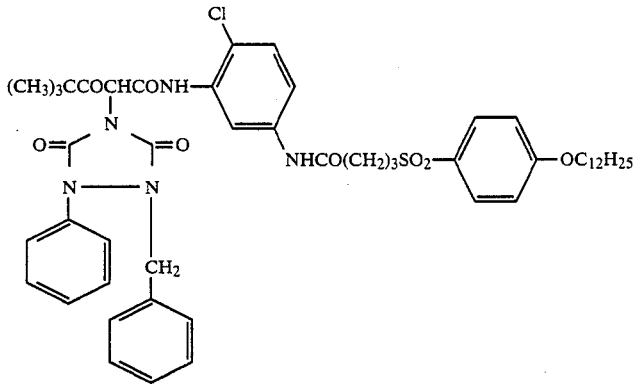
(Y-24)
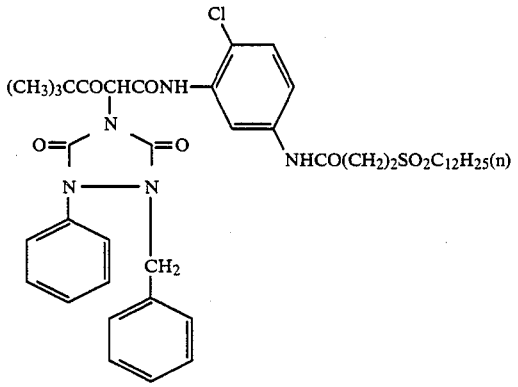

-continued
[Example compounds]
(Y-25)
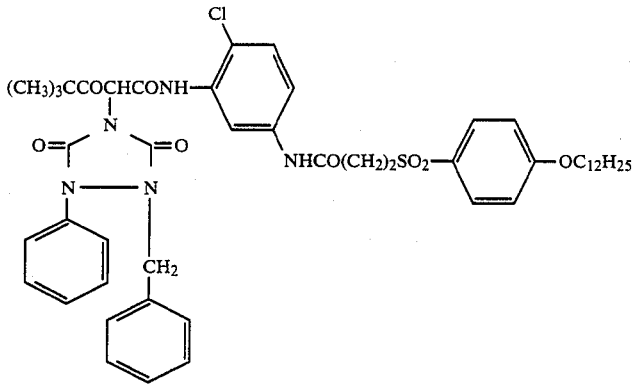
(Y-26)
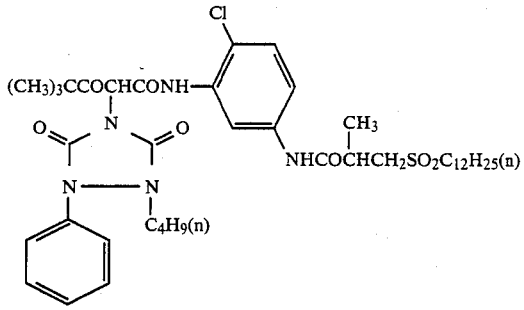
(Y-27)
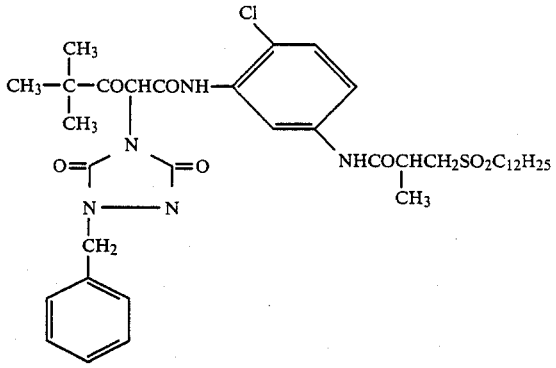
(Y-28)
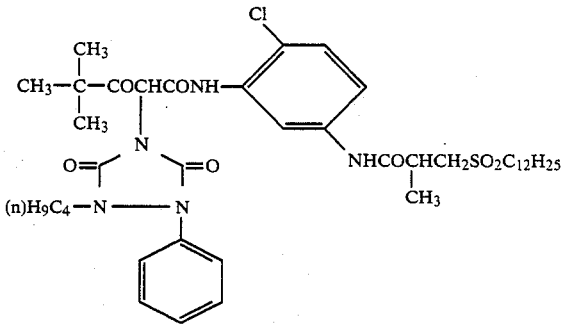

-continued
[Example compounds]
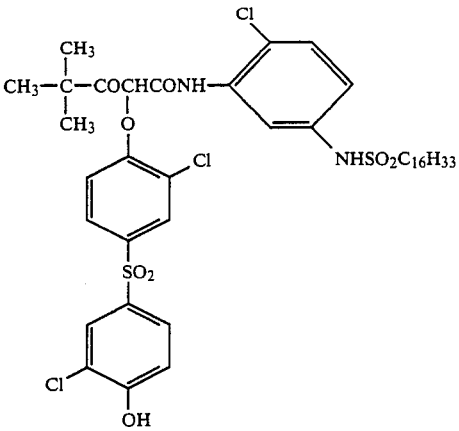
(Y-29)
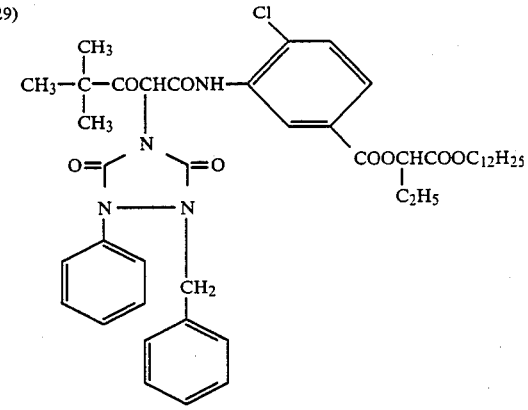
(Y-30)
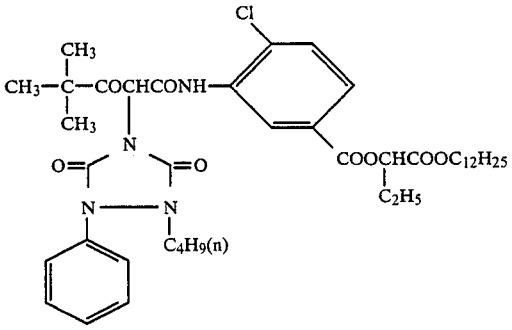
(Y-31)
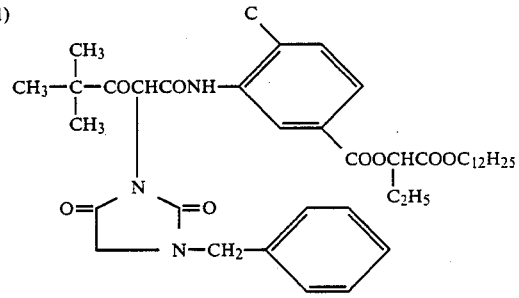
(Y-32)
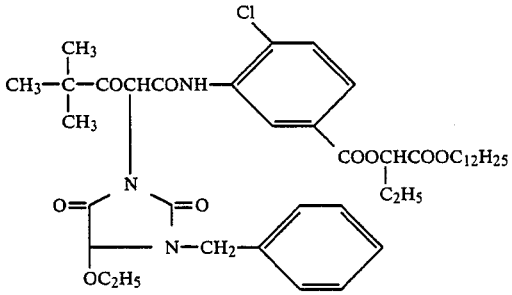
(Y-33)
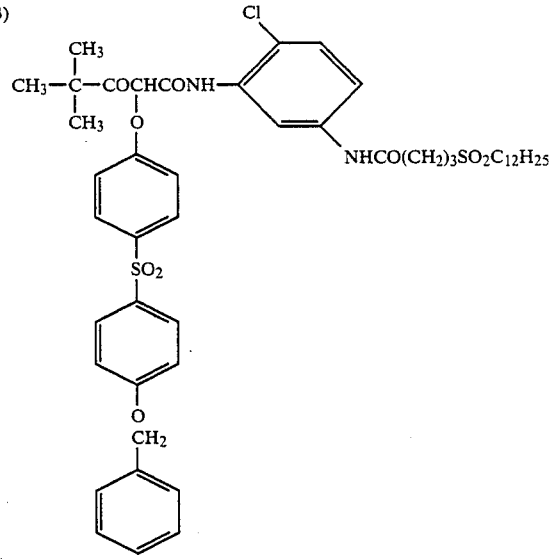
(Y-34)

-continued
[Example compounds]
(Y-35)
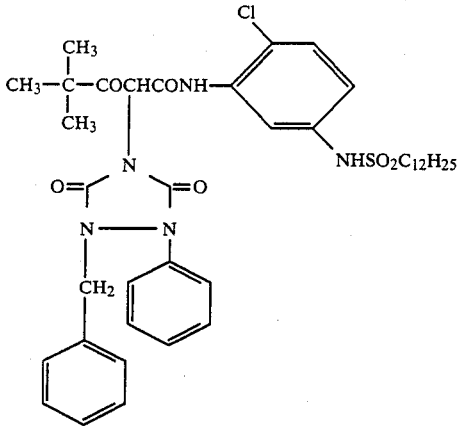
(Y-36)
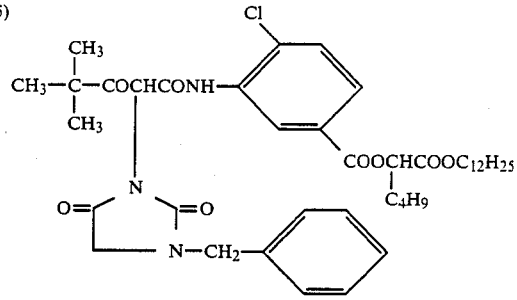
(Y-37)
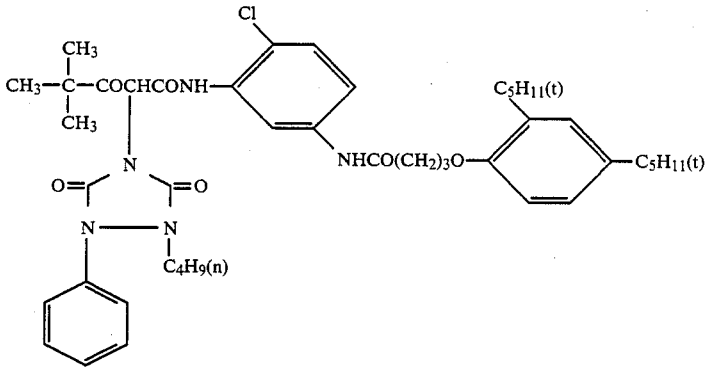
(Y-38)
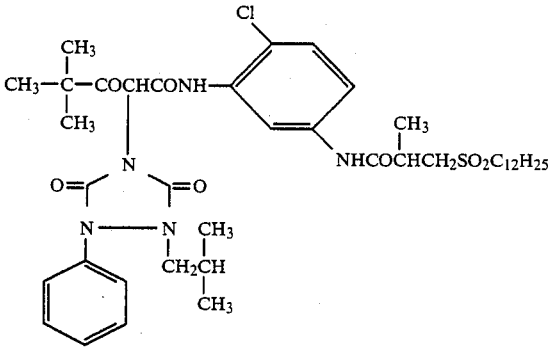
(Y-39)
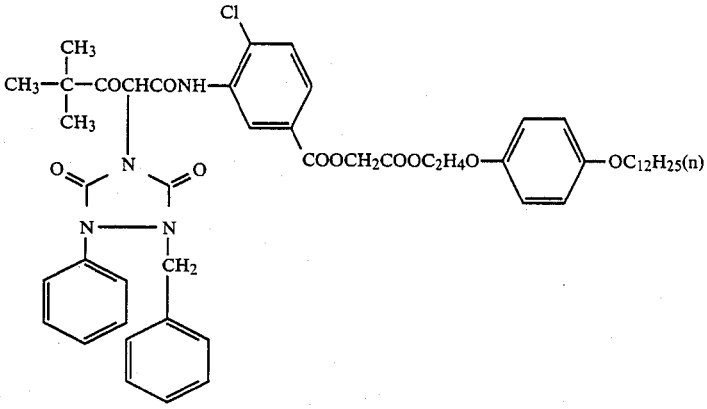

-continued
[Example compounds]
(Y-40)
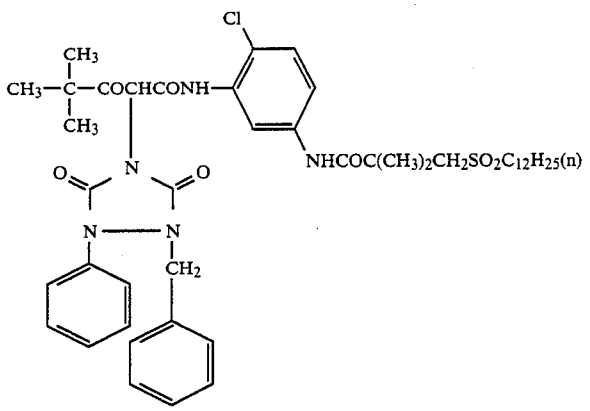
(Y-41)
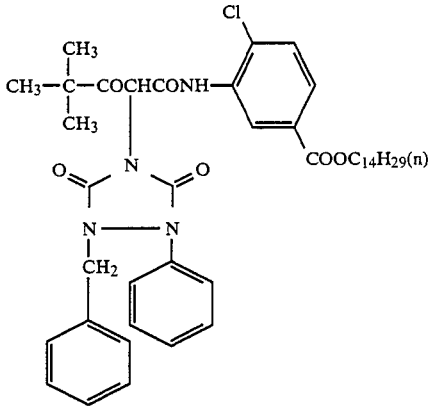
(Y-42)
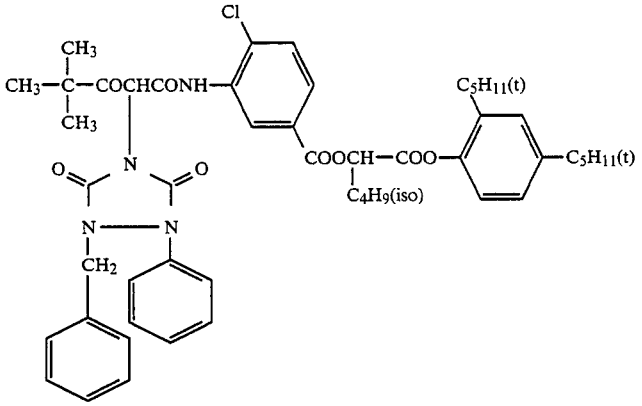
(Y-43)
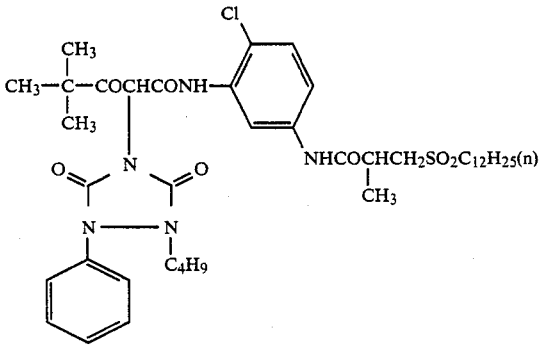

-continued
[Example compounds]

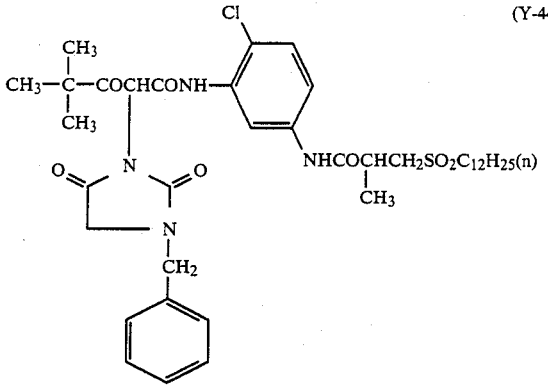

(Y-44)

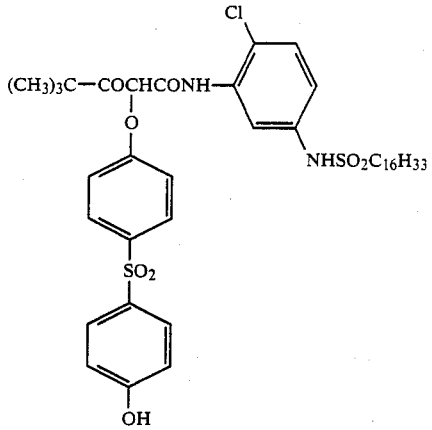

(Y-45)

The above yellow couplers are used at a rate of 0.02–1 mol, favorably, 0.05–0.75 mol, more favorably, 0.05–0.75 mol, and most favorably 0.1–0.5 mol per mol silver halide. The above yellow coupler may be used as a mixture comprising, at an arbitrarily selected ratio, more than two similar couplers.

Magenta couplers suitable for use include, for example, those mentioned in the respective specifications of U.S. Pat. Nos. 1,969,479, 2,213,986, 2,294,909, 3,338,677, 2,340,763, 2,343,703, 2,359,332, 2,411,951, 2,435,550, 2,592,303, 2,600,788, 2,618,641, 2,619,419, 2,673,801, 2,691,659, 2,803,554, 2,829,975, 2,866,706, 2,881,167, 2,895,826, 3,026,653, 3,127,269, 3,214,437, 3,253,924, 3,311,476, 3,419,391, 4,486,894, 3,519,429, 3,558,318, 3,617,291, 3,684,514, 3,705,896, 3,725,067, and 3,888,680, British Patent Nos. 720,284, 737,700, 813,866, 892,886, 918,128, 1,019,117, 1,042,832, 1,047,612, 1,398,828, and 1,398,979, German Patent Publication Nos. 814,996, and 1,070,030, Belgian Patent Publication No. 724,427, and Japanese Published Unexamined Patent Application Nos. 46-60479, 49-29639, 49-111631, 49-129538, 50-13041, 50-116471, 50-159336, 51-3232, 51-3233, 51-10935, 51-16924, 51-20826, 51-26541, 51-30228, 51-36938, 51-37230, 51-37646, 51-39039, 51-44927, 51-104344, 51-105820, 51-108842, 51-112341, 51-112342, 51-112343, 51-112344, 51-117032, 51-126831, 52-31738, 53-9122, 53-35122, 53-75930, 53-86214, 53-25835, 53-123129, and 54-56429.

Cyan couplers suitable for use include, for example, those mentioned in the respective specifications of U.S. Pat. Nos 2,306,410, 2,356,475, 2,362,598, 2,367,531, 2,369.929, 2,423,730, 2,474,293, 2,476,008, 2,498,466, 2,545,687, 2,728,660, 2,772,162, 2,895,826, 2,976,146, 3,002,836, 3,419,390, 3,445,622, 3,476,563, 3,737,316, 3,758,308, and 3,839,044, British Pat. Nos. 478,991, 945,542, 1,084,480, 1,377,233, 1,388,024, and 1,543,040, and Japanese Published Unexamined Patent Application Nos. 47-37425, 50-10135, 50-130441, 51-6551, 51-37647, 51-52828, 51-108841, 53-109630, 54-48237, 54-66129, 54-131931, and 55-32071.

Couplers capable of forming a coupling product having a maximal spectral absorption wavelength in a wavelength region of 700 nm to 850 nm are mentioned in Japanese Published Examined Patent Application No. 52-24849, and Japanese Published Unexamined Patent Application Nos. 53-125836, 53-129036, 55-21094, 55-21095, and 55-21096.

Such coupler is incorporated into a silver halide emulsion by using a high boiling point organic solvent and a dispersing agent.

Various compounds may be contained in the silver halide photosensitive material of the invention in order to inhibit fogging in the course of manufacture or storing thereof, or in the process of development, or to stabilize the photographic performance of the material.

For example, any of the following may be added: tetrazinedenes, azoles, such as benzothiazolium salts, nitroindazoles, nitrobenzoimidazoles, chlorobenzoimidazoles, bromobenzoimidazoles, memercaptothiazoles, mercaptobenzoimidazoles, aminotriazoles, benzotriazoles, nitrobenzotriazoles, mercaptotetrazoles 9 more specifically, 1-phenyl-5-mercaptotetrazole); mercaptopyrimidines, mercaptotriadines including oxazolithione and the like compounds; and various other compounds known as antifoggants or stabilizers, such as benzene thiosulfonic acid, benzenesulfonic acid, benzenesulfonamide, hydroquinone derivatives, aminophenol derivatives, gallic acid derivatives, and ascorbic acid derivatives.

Hydrophilic colloids useful for forming a hydrophilic colloidal layer in the silver halide photosensitive material of the invention are not particularly limited. For example, gelatin and various other colloids may be used as binders for photosensitive and nonphotosensitive layers as required. Besides gelatin, the following may be used; colloidal albumin, agar-agar, gum arabic, dextrin, alginic acid, cellulose derivative, such as a cellulose acetate hydrolyzed to an acetyl content of 19–26%, for example, polyacrylamide, imidized polyacrylamide, casein, urethane carboxylic acid group, such as vinylalcohol-vinyl cyanoacetate copolymer or vinylalcohol copolymer containing a cyanoacetyl group, polyvinylalcohol-polyvinylpyrolidone, hydrolyzed polyvinyl acetate, a polymer produced by polymerization of a protein or a saturated protein acylate with a monomer having a vinyl group, polyvinyl pyridine, polyvinyl amine, polyamine ethylmethacrylate, and polyethylene imine.

Any suitable compound may be used as a hardening agent. For example, one of such organic hardening agents as vinylsulfone, acryloyl, and ethylene imine and/or such inorganic hardening agents as chrome alum and potassium alum, or a combination of two or more kinds of such agents may be used as such.

The photosensitive material of the invention may contain a surface active agent for coat assisting, antistatic, emulsion dispersing, slip facilitating, emulsion dispersing, and adhesion inhibiting purposes.

Surface active agents useful for these purposes include, for example, saponin, sodium dodecylbenzene sulfonate, sodium sulfosuccinate, and also those mentioned in japanese Published Unexamined Patent Application Nos. 49-46733, 49-10722, and 50-16525.

Further it is possible to use, as a ultraviolet light absorber, any of such compounds as bezotriazoles, thiazolidones, acrylonitriles, and benzophenones. In addition, antistatic, optical bleaching, antioxidant, and stainproofing agents may be used as required. In order to obtain the photosensitive material of the invention, a photographic additive is incorporated into the silver halide emulsion, and then a silver halide emulsion layer is formed on a base. In this case, if so desired, a subbing layer and an intermediate layer may be formed between the base and the silver halide emulsion layer.

Materials useful for the base include, for example, paper, glass, cellulose acetate, cellulose nitrate, polyester, polyamide, and polystyrene. Bonded materials consisting of a laminate of two or more kinds of base materials, such as, for example, paper and olefin (e.g., polyethylene, polypropylene, or the like), may also be used. In order to assure improved bond between the base and the silver halide emulsion layer, the base material is generally subjected to various sorts of surface treatment, such as electron bombardment treatment and subbing treatment for formation of a subbing layer.

In order to coat a photographic silver halide emulsion on the base and allow it to dry, a generally known coating method, such as dip coating, roller coating, bead coating, or curtain flow coating, is employed; drying follows coating.

The photosensitive material may be developed by a conventional color development process.

Color developing agents useful for color development inculde aromatic primary amine compounds, such as, for example, N-diethyl-p-phenylene diamine, N-ethyl-N-hydroxyethyl paraphenylene diamine, 4-(N-ethyl-N-hydroxyethyl)amino-2-methylaniline, 4-(N-ethyl-N-β-methanesulfone amide ethyl)amino-2-methylaniline, 4-(N,N-diethyl)amino-2-methylaniline, and 4-(N-ethyl-N-methoxyethyl)amino-2-methylaniline, and their sulfates, hydrochlorides, sulfites, and p-toluene sulfonates.

A rapid color developer in particular may contain various developer additives in addition to aforesaid color developing agent and N,N-dialkyl hydroxylamine salt as a preserver.

For example, alkaline agents, such as sodium hydroxide, potassium hydroxide, sodium carbonate, potassium carbonate, sodium metaborate, and tribasic potassium phosphate, pH buffers, such as sodium phosphate, potassium dihydrogen phosphate, sodium dihydrogen phosphate, and potassium bicarbonate, and organic solvents, such as methanol, ethyleneglycol, and triethanolamine, may be selectively used as required.

The color developing solution may contain benzil alcohol as a color improver, but preferably it contains no such agent.

The solution may contain a small amount of such color improver. In that case, the amount of benzil alcohol in the color developing solution is preferably 0 to 5 ml per liter of the solution, more preferably 0 to 3 ml. In order to improve the preservability of the color developing solution, it is particularly desirable to use sulfites, such as sidium sulfite and potassium sulfite, in combination with aforesaid N,N-dialkylhydroxylamine in the solution. Such sulfite is used preferably in the proportion of 0.05 g to 12 g per liter of the solution, more preferably 0.1 g to 0.3 g.

A water-soluble bromide, as a development restrainer, contained, if any, in the color developing solution should be preferably of a minimal amount. The solution may contain a slight amount of such bromide, but most preferably it contains no bromide.

The term "rapid processing" generally means that time taken for color development is less than 90 seconds. The temperature of the color developing solution is within the range of 20° C. to 50° C., preferably 30° C. to 40° C.

In rapid processing, it is necessary that after a dye image is formed, undeveloped silver halide and developed image silver be removed by bleach-fixing.

Time for bleach-fixing is preferably less than 90 seconds, more preferably less than 60 seconds.

Preferred bleaching agents for developed silver are polymetallic salts of organic acids. For such polymetallic salts, ferric salts of organic acids are mentioned by way of example.

More specifically, they include, for example, ferric salts of: nitrilotriacetic acid, diethylenetriaminepentaacetic acid, ethyleneglycol-bis(aminoethylether)tetraacetic acid, diaminopropanoltetraacetic acid, N-(2-hydroxyethyl)ethylenediaminetriacetic acid, ethyliminodipropionic acid, cyclohexanediaminetetraacetic acid, and ethylenediaminetetraacetic acid. Ferric salts of polycarboxylic acids as mentioned in Japanese Published Unexamined Patent Application No. 49-107737 may also be used, which include, for example, salts of oxalic acid, malonic acid, succinic acid, tartaric acid, malic acid, tartaric acid, citric acid, and salicylic acid. Among polymetallic salts useful for the purpose of the invention are cupric salts and cobalt (II) salts in addition to aforesaid ferric salts. Further, inorganic polymetallic acids, such as ferric chloride and ferric sulfate, may be used depending upon the intended object. For the purpose of fixation, known agents, such as thiosulfate and thiocyanate, may be contained in the solution. Also, water soluble alkaline metallic salts, or bromides or iodides of ammonium, as described in Japanese Published Unexamined Patent Application No. 48-101934, in which are mentioned potassium bromide, ammonium bromide, sodium iodide as such, may be used for the purpose.

In combination with the process of color development and bleach-fixing, such other processing stages as prehardening, neutralizing, washing, and stabilization may be carried out as required.

EXAMPLE

The following examples are given to further illustrate the invention. It is to be understood, however, that the mode for carrying out the invention is not limited by these examples.

EXAMPLE 1

A silver halide emulsion composed of silver chlorobromide grains having a mean grain diameter of 0.6 μm and a uniform silver chloride content of 10 mol% [Em−1] was prepared by a simultaneous mixing method. Nextly, a silver halide emulsion composed of silver chlorobromide grains having a mean grain diameter of 0.6 μm and uniformly containing 3 mol% of silver bromide [Em−2] was prepared by same mixing method.

These emulsions, [Em−1] and [Em−2], were respectively divided into parts, and in a manner as shown in Table 1, sodium thiosulfate, diphenyl thiourea, sodium thiosulfate+gold compound, and diphenyl thiourea+gold compound were added to said parts of [Em−1] and [Em−2]. Ripening was effected until a maximal sensitivity was reached. Subsequently, $3\times10^{-4}$ mol/AgX of the spectral sensitizing dye mentioned in Table 1 was added and then an antifoggant and a stablizer were added. Further, aforesaid coupler (Y−2), a yellow coupler, was added. On a resin coated base was placed an emulsion layer in such a manner that the emulsion coat comprises 4.0 mg/dm$^2$ of metallic silver, 30 mg/dm$^2$ of gelatin, and 0.75 g/l m$^2$. A protective layer was formed on the emulsion layer by placing a 10 mg/dm$^2$ coat of gelatin thereon. In this way test samples were prepared. These samples were subjected to light intensity scale exposure by a conventional method. Then, color development was carried out under the conditions indicated below. With dye images thus obtained, density measurement was made by employing a PDA-65 desitometer (made by Konishiroku Photo Industry Co., Ltd.) and through a blue filter. Results are shown in Table 1. In the table, $\gamma_2$ represents gradation under reflection desity of 0.2–0.7 (gradation at toe), and $\gamma_1$ represents gradation under reflection density of 0.7–2.0 (gradation at shoulder).

Sensitivity values in Table 1 refer to relative sensitivity values and correspond to values calculated relative to the sensitivity in the color development of sample No. 105 under processing mode A which is taken as 100.

processing stages are as mentioned below. Processing was carried out under two different modes, [A] (3 min development) and [B] (45 sec development).

| Stage | [A] Color develop bath [A] | [B] Color develop bath [B] |
|---|---|---|
| Color development | 35° C. 3 min | 35° C. 45 sec |
| Bleach/fix | 35° C. | 1 min |

-continued

| Stage | [A] Color develop bath [A] | [B] Color develop bath [B] |
|---|---|---|
| Color development | 35° C. 3 min | 35° C. 45 sec |
| Washing | 30–34° C. | 2 min |
| Drying | 60–80° C. | 2 min |

Compositions of the color developing and bleach/fix solutions used are shown below.

| Color Developing Solution | A | B |
|---|---|---|
| Pure water | 800 ml | 800 ml |
| Ethylene glycol | 15 ml | — |
| Benzyl alcohol | 15 ml | — |
| N,N—diethylhydroxylamine | — | 6 ml |
| Potassium chloride | 2.0 g | 2.0 g |
| Potassium brimide | 0.8 g | — |
| Potassium sulfite | 2 g | 0.2 g |
| N—ethyl-N—β-metasulfoneamide ethyl-3-methyl-4-amino aniline sulfate | 5 g | 5 g |
| Tetrasodium polyphosphate | 2 g | 2 g |
| Potassium carbonate | 30 g | 30 g |
| Triethanolamine | — | 8.3 g |

Add pure water until the quantity of the solution reaches 1 l. Adjust pH to 10.08.

| Bleach/Fix Solution | |
|---|---|
| Pure water | 800 ml |
| Ethylenediaminetetra iron acetate (III) Ammonium | 65 g |
| Ethylenediaminetetraacetic acid-2-Sodium | 5 g |
| Ammonium thiosulfate | 85 g |
| Sodium bisulfite | 10 g |
| Sodium metabisulfite | 2 g |
| Sodium chloride | 10 g |
| Hydroxylamine sulfate | 2 g |

Add pure water until the quantity of the solution reaches 1 l.

Adjust to pH=7.0 with dilute sulfuric acid. However, if processing is carried with said B developing solution, a bleach/fix solution of which pH has been adjusted to 6.2 should be used.

TABLE 1

| Test piece No. | Emulsion | Sodium thiosulfate mol/AgX mol | Diphenyl thiourea mol/AgX mol | Spectral sensitizing dye | Gold chloride mol/AgX mol | Color develop solution A (sensitivity and gradation due to process) | | | Color develop solution B (sensitivity and gradation due to process) | | | Invention/reference |
|---|---|---|---|---|---|---|---|---|---|---|---|---|
| | | | | | | Sensitivity | γ1 | γ2 | Sensitivity | γ1 | γ2 | |
| 101 | Em-1 | $3.5\times10^{-6}$ | — | A | — | 70 | 3.85 | 2.70 | 35 | 2.25 | 1.30 | Reference |
| 102 | Em-1 | $3.5\times10^{-6}$ | — | B | — | 80 | 3.80 | 2.80 | 40 | 2.20 | 1.40 | Reference |
| 103 | Em-1 | $3.5\times10^{-6}$ | — | C | — | 80 | 3.90 | 2.75 | 40 | 2.30 | 1.30 | Reference |
| 104 | Em-1 | $3.5\times10^{-6}$ | — | I-1 | — | 110 | 3.85 | 2.70 | 50 | 2.25 | 1.35 | Reference |
| 105 | Em-1 | $3.5\times10^{-6}$ | — | I-2 | — | 100 | 3.85 | 2.70 | 55 | 2.10 | 1.30 | Reference |
| 106 | Em-1 | $3.5\times10^{-6}$ | — | I-3 | — | 100 | 3.809 | 2.65 | 50 | 2.15 | 1.40 | Reference |
| 107 | Em-1 | — | $1.3\times10^{-6}$ | I-7 | — | 105 | 3.85 | 2.70 | 60 | 2.20 | 1.30 | Reference |
| 108 | Em-1 | — | $1.3\times10^{-6}$ | I-4 | — | 110 | 3.90 | 2.75 | 60 | 2.30 | 1.40 | Reference |
| 109 | Em-2 | $1.7\times10^{-6}$ | — | A | — | 40 | 3.75 | 2.70 | 40 | 3.70 | 2.70 | Reference |
| 110 | Em-2 | $1.7\times10^{-6}$ | — | B | — | 60 | 3.75 | 2.75 | 60 | 3.75 | 2.73 | Reference |
| 111 | Em-2 | $1.7\times10^{-6}$ | — | C | — | 60 | 3.85 | 2.65 | 60 | 3.80 | 2.60 | Reference |
| 112 | Em-2 | $1.7\times10^{-6}$ | — | I-1 | — | 110 | 3.70 | 2.50 | 100 | 3.50 | 2.20 | Reference |
| 113 | Em-2 | $1.7\times10^{-6}$ | — | I-2 | — | 100 | 3.65 | 2.45 | 103 | 3.45 | 2.20 | Reference |
| 114 | Em-2 | $1.7\times10^{-6}$ | — | I-3 | — | 100 | 3.70 | 2.45 | 100 | 3.50 | 2.25 | Reference |
| 115 | Em-2 | $1.7\times10^{-6}$ | — | I-6 | — | 103 | 3.70 | 2.40 | 103 | 3.40 | 2.10 | Reference |
| 116 | Em-2 | — | $8.0\times10^{-5}$ | I-7 | — | 105 | 3.75 | 2.50 | 105 | 3.45 | 2.20 | Reference |
| 117 | Em-2 | — | $8.0\times10^{-5}$ | I-4 | — | 110 | 3.80 | 2.50 | 110 | 3.40 | 2.25 | Reference |
| 118 | Em-2 | $3.5\times10^{-6}$ | — | C | $2.7\times10^{-6}$ | 60 | 3.80 | 2.70 | 60 | 3.80 | 2.70 | Reference |
| 119 | Em-2 | $3.5\times10^{-6}$ | — | C | $3.4\times10^{-6}$ | 60 | 3.90 | 2.80 | 60 | 3.90 | 2.80 | Reference |
| 120 | Em-2 | $3.5\times10^{-6}$ | — | I-1 | $2.7\times10^{-6}$ | 100 | 3.85 | 2.75 | 100 | 3.85 | 2.75 | Invention |

TABLE 1-continued

| Test piece No. | Emulsion | Sodium thiosulfate mol/AgX mol | Diphenyl thiourea mol/AgX mol | Spectral sensitizing dye | Gold chloride mol/AgX mol | Color develop solution A (sensitivity and gradation due to process) | | | Color develop solution B (sensitivity and gradation due to process) | | | Invention/reference |
|---|---|---|---|---|---|---|---|---|---|---|---|---|
| | | | | | | Sensitivity | $\gamma 1$ | $\gamma 2$ | Sensitivity | $\gamma 1$ | $\gamma 2$ | |
| 121 | Em-2 | $3.5 \times 10^{-6}$ | — | I-2 | $2.7 \times 10^{-6}$ | 103 | 3.85 | 2.70 | 103 | 3.80 | 2.70 | Invention |
| 122 | Em-2 | $3.5 \times 10^{-6}$ | — | I-3 | $2.7 \times 10^{-6}$ | 100 | 3.80 | 2.70 | 100 | 3.80 | 2.70 | Invention |
| 123 | Em-2 | $1.7 \times 10^{-6}$ | — | I-6 | $2.7 \times 10^{-6}$ | 103 | 3.70 | 2.65 | 103 | 3.70 | 2.65 | Invention |
| 124 | Em-2 | $1.7 \times 10^{-6}$ | — | I-9 | $2.7 \times 10^{-6}$ | 100 | 3.85 | 2.60 | 100 | 3.85 | 2.60 | Invention |
| 125 | Em-2 | $1.7 \times 10^{-6}$ | — | I-11 | $2.7 \times 10^{-6}$ | 105 | 3.80 | 2.75 | 105 | 3.75 | 2.75 | Invention |
| 126 | Em-2 | $1.7 \times 10^{-6}$ | — | I-10 | $2.7 \times 10^{-6}$ | 100 | 3.85 | 2.75 | 100 | 3.85 | 2.75 | Invention |
| 127 | Em-2 | $1.7 \times 10^{-6}$ | — | I-14 | $3.4 \times 10^{-6}$ | 105 | 3.90 | 2.80 | 105 | 3.85 | 2.75 | Invention |
| 128 | Em-2 | $1.7 \times 10^{-6}$ | — | I-16 | $3.4 \times 10^{-6}$ | 103 | 3.80 | 2.75 | 103 | 3.80 | 2.75 | Invention |
| 129 | Em-2 | — | $1.3 \times 10^{-6}$ | I-1 | $3.4 \times 10^{-6}$ | 100 | 3.85 | 2.70 | 100 | 3.85 | 2.75 | Invention |
| 130 | Em-2 | — | $1.3 \times 10^{-6}$ | I-4 | $1.0 \times 10^{-6}$ | 110 | 3.90 | 2.75 | 110 | 3.90 | 2.75 | Invention |
| 131 | Em-2 | — | $1.3 \times 10^{-6}$ | I-17 | $8 \times 10^{-6}$ | 105 | 3.80 | 2.65 | 105 | 3.80 | 2.60 | Invention |
| 132 | Em-2 | $1.7 \times 10^{-6}$ | — | I-1 | $8 \times 10^{-3}$ | 90 | 3.90 | 3.00 | 90 | 3.90 | 3.00 | Reference |
| 133 | Em-2 | $1.7 \times 10^{-6}$ | — | I-2 | $5 \times 10^{-8}$ | 100 | 3.40 | 2.20 | 100 | 3.20 | 2.00 | Reference |

The following facts can be seen from Table 1.

Referring to test piece Nos. 101–108 using Em—1 emulsion having a high silver bromide content, those in which reference spectral sensitizing dyes A, B, C were used (sample Nos. 101–103) showed low sensitivity values, but those using spectral sensitizing dyes expressed by the general formula [I] (sample Nos. 104–108) showed high sensitivity values. In the latter mentioned case, their $\gamma_1$, $\gamma_2$ values showed satisfactory gradation. However, the results of 45 sec rapid processing (in the present instance, a developing solution containing no benzil alcohol was used) show that sensitivity values decreased further with sample Nos. 101–103, and those of sample Nos. 101–103 also dropped noticeably. They all showed soft gradation and no satisfactory image was obtained. No doubt, with an emulsion having such a high silver bromide content, rapid processing could not obtain any satisfactory image. Where such emulsion is used, therefore, it is impracticable to carry out rapid processing.

With samples using emulsion Em—2 having a silver chloride content of 97%, it was found that where they contained reference spectral sensitizing dyes A, B, C (sample Nos. 109–111), their sensitivity was low even after 3 min development and their $\gamma_1$, $\gamma_2$ values were lower than those of sample Nos. 101–103, showing soft gradation. However, 45 min development of said test piece Nos. 109–111 showed no such change in either sensitivity or gradation as compared with the case of 3 min development, though there were some slight variation. There was no particular indication of performance drop due to rapid development. It can be seen from this that an emulsion having a high silver bromide content is suitalbe for rapid processing, though it is likely to cause soft gradation.

With test piece Nos. 112–117 using emulsion Em—2 with spectral sensitizing dyes expressed by the general formula [I], as is clear from the 3 min processing data, fairly high sensitivity values were obtained, but they showed much lower gradation than those containing reference sensitizing dyes (sample Nos. 109–111). Results of 45 sec processing shoed that their $\gamma_1$, $\gamma_2$ values are lower than those of test piece Nos. 109–111, which means softer gradation. Thus, it can be said that it is possible to obtain high sensitivity on one hand by incorporating any spectral sensitizing dye into an emulsion having a high silver chloride content, but on the other hand it is apparent that it results in lowered gradation.

Sample Nos. 118 and 119 use emulsion Em—2 containing reference sensitizing dye C and gold chloride. A comparison of these samples with sample No. 111 shows that the presence of the gold compound can give some improvement in $\gamma_1$, $\gamma_2$ thus producing somewhat high contrast. However, sensitivity, remains low.

Sample Nos. 120–131 represent the present invention. As can be clearly seen from a comparison of these pieces with test piece Nos. 118, 119, the test pieces of the invention have an advantage in the degree of improvement in $\gamma_1$, $\gamma_2$ values due to the presence of the gold compound. Thus, greater high contrast effect of the gold compound can be obtained when spectral sensitizing dyes expressed by the general formula [I] are used. Furthermore, the samples of the invention showed much higher sensitivity since the compounds exemplified earlier as those expressed by the general formula [I] were incorporated in them. On the other hand, no soft gradation effect was seen with the samples Nos. 120–131, and $\gamma_1$, $\gamma_2$ values of the test pieces in the case of 3 min processing were well comparable to those of samples Nos. 101–108 in 3 min processing. Moreover, when 45 sec rapid processing was carried out, the samples of the invention showed almost no change in either sensitivity or gradation, proving their suitableness for rapid processing.

As described above, according to the invention, it is possible to obtain high sensitivity by incorporating a spectral sensitizing dye expressed by the general formula [I] and a sulfur sensitizing agent into an emulsion having a high silver chloride content, and further to restrain, by using a gold compound, such soft gradation tendency as may otherwise occur when any spectral sensitizing dye of the general formula [I] is used in an emulsion having a high silver chloride content. Thus, it is clear that the photosensitive material of the invention is rapidly processable, highly sensitive, and is free from gradation lowering.

Sample No. 132 is one having a larger amount of gold compound than the content range of such compound specified by the invention. The test results show that it is less sensitive and produces excessively high contrast gradation. Therefore, it cannot provide any satisfactory image. Sample No. 133 is a case contrary to this, that is, having an excessively small amount of such compound. The image obtained is of excessively low gradation. Reference compounds

A

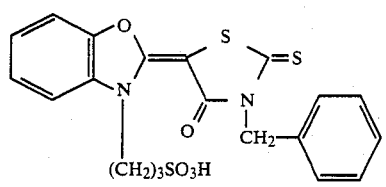

B

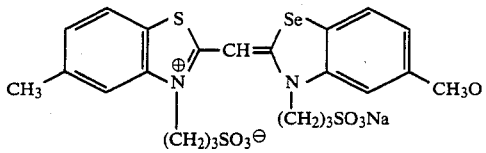

C

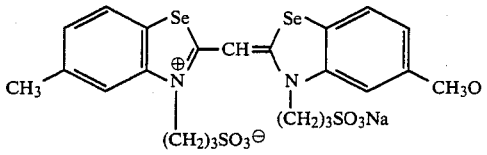

CY-1

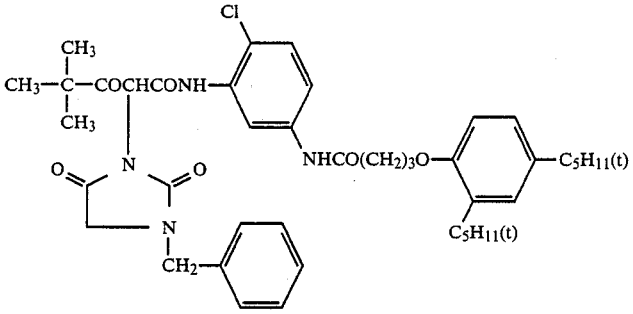

EXAMPLE 2

Samples were prepared which were same as sample Nos. 120, 127 using emulsion Em−2 in Example 1 except that yellow coupler CY-1 was used instead of yellow coupler Y-1 in the samples 120, 127. The samples so prepared were referred to as samples 201, 202. With these samples, color development was carried out using color developing solution P-2 (which did not contain benzyl alcohol) and another color development solution comprising 15 ml of benzyl alcohol added to the ingredients of developer A respectively. Reflective maximum density (Dmax) were measured by employing same densitomer as used in Example 1.

Results are shown in Table 2.

give high Dmax in the one color developing solution which contained no benzyl alcohol (hereinafter referred to as BeOH). With sample Nos. 203 and 204 using (Y-1) yellow coupler (in same way as sample Nos. 120, 127 in Example 1), it was found that same degree of sensity as was attained by samples 201, 202 (using CY-1) when BeOH was used could be attained even if BeOH was not used.

Further it was found that test pieces 203, 204 (Nos. 120, 127) could give higher color dye image density in a color developing solution in which BeOH was used. Samples 205–209 were such that yellow couplers Y-4, Y-39, Y-6, Y-43 or Y-43 each was substituted for yellow coupler (Y-1) in sample 204 (sample 127 in Example 1).

TABLE 2

| Sample No. | Emulsion | Sodium thiosulfate mol/AgX mol | Gold chloride mol/AgX mol | Yellow coupler | Color develop solution B Color dye reflection density: With benzyl alcohol | Without benzyl alcohol | Remark |
|---|---|---|---|---|---|---|---|
| 201 | Em-2 | $3.5 \times 10^{-6}$ | $2.7 \times 10^{-6}$ | CY-1 | 2.50 | 2.40 | Invention |
| 202 | Em-2 | $1.7 \times 10^{-6}$ | $3.4 \times 10^{-6}$ | CY-1 | 2.55 | 2.40 | Invention |
| 203 (120) | Em-2 | $3.5 \times 10^{-6}$ | $2.7 \times 10^{-6}$ | Y-1 | 2.70 | 2.60 | Invention |
| 204 (127) | Em-2 | $1.7 \times 10^{-6}$ | $3.4 \times 10^{-6}$ | Y-1 | 2.70 | 2.60 | Invention |
| 205 | Em-2 | $1.7 \times 10^{-6}$ | $3.4 \times 10^{-6}$ | Y-4 | 2.75 | 2.60 | Invention |
| 206 | Em-2 | $1.7 \times 10^{-6}$ | $3.4 \times 10^{-6}$ | Y-39 | 2.75 | 2.55 | Invention |
| 207 | Em-2 | $1.7 \times 10^{-6}$ | $3.4 \times 10^{-6}$ | Y-6 | 2.65 | 2.50 | Invention |
| 208 | Em-2 | $1.7 \times 10^{-6}$ | $3.4 \times 10^{-6}$ | Y-43 | 2.78 | 2.63 | Invention |
| 209 | Em-2 | $1.7 \times 10^{-6}$ | $3.4 \times 10^{-6}$ | Y-44 | 2.77 | 2.63 | Invention |

It can be seen that as compared with (Y-1) yellow coupler used in Example 1, CY-1 coupler is less likely to A tendency similar to the one observed with samples 203, 204 was seen with these samples 205–209.

EXAMPLE 3

Ripening was carried out with emulsion Em−2 by using the sodium thiosulfate in Table 3. Then, $3\times10^{-4}$ mol/Ag mol of the spectral sensitizing dye [I−1] of the invention was added. Successively thereafter, a gold compoun (e.g., gold chloride) was added in such amount as shown in Table 3 and the emulsion was subjected to ripening for 10 min. An antifoggant and a stabilizer were added. Same coupler as used in Example 1 was then added, and sample Nos. 301–305 in Table 3 were thus prepared. After subjected to exposure, the test pieces were processed for development with (B) developing solution (containing neither benzyl alcohol nor potassium bromide).

Measurements were made in same way as in Example 1. Results are shown in Table 3.

TABLE 3

| Sample No. | Emulsion | Sodium thiosulfate mol/AgX mol | Gold chloride mol/AgX mol | Sensitivity, gradation due to color develop solution P-2 | | |
|---|---|---|---|---|---|---|
| | | | | Sensitivity | $\gamma_1$ | $\gamma_2$ |
| 301 | Em-2 | $3.5\times10^{-6}$ | — | 110 | 3.40 | 2.20 |
| 302 | Em-2 | $3.5\times10^{-6}$ | $3\times10^{-6}$ | 110 | 3.85 | 2.75 |
| 303 | Em-2 | $3.5\times10^{-6}$ | $2\times10^{-6}$ | 110 | 3.83 | 2.72 |
| 304 | Em-2 | $3.5\times10^{-6}$ | $5\times10^{-8}$ | 110 | 3.45 | 2.25 |
| 305 | Em-2 | $3.5\times10^{-6}$ | $8\times10^{-3}$ | 90 | 3.95 | 3.10 |

As is apparent from Table 3, any gold compoun used in the invention, if not subjected to ripening in conjunction with a yellow sensitizer, can produce same effect as was observed in Example 1 by being added to the emulsion in such amount as specified by the invention. apparently, the presence of such amount of gold compound serves to positively compensate the negative effect on gradation of the developing solution which contains no potassium bromide or BeOH (sample Nos. 302 and 303).

EXAMPLE 4

Dye [I] was used in same way as was the case with sample 302 in Example 3, except that proportions of the dye were varied as shown in Table 4.

As can be seen clearly from the test results of sample Nos. 401–403, no sensitivity drop could be found with the photosensitive material of the invention if the dye is used within the specified quantity range of the invention, the test pieces showing good performance in both gradation and sensitivity. With sample No. 404, in which the quantity of the dye exceeds the permissible quantity range of the invention, even the addition of gold compound does not serve to recover good gradation. With sample No. 405, in which the quantity of the dye is lower than the lowest quantity limit of the invention, there was no downward change in gradation, but considerable drop in sensitivity was observed.

TABLE 4

| Sample No. | Spectral sensitizing dye | sensitivity, gradation due to processing with B solution | | |
|---|---|---|---|---|
| | | Sensitivity | $\gamma_1$ | $\gamma_2$ |
| 401 | $3\times10^{-4}$ | 110 | 3.85 | 2.75 |
| 402 | $5\times10^{-5}$ | 110 | 3.85 | 2.75 |
| 403 | $1\times10^{-3}$ | 110 | 3.86 | 2.75 |
| 404 | $\times10^{-3}$ | 110 | 3.40 | 2.25 |

TABLE 4-continued

| Sample No. | Spectral sensitizing dye | sensitivity, gradation due to processing with B solution | | |
|---|---|---|---|---|
| | | Sensitivity | $\gamma_1$ | $\gamma_2$ |
| 405 | $9\times10^{-7}$ | 50 | 3.85 | 2.75 |

EXAMPLE-5

According to a conventional technique, the silver chlorobromide emulsion with the halogen composition in the following Table-2 was prepared by the double jet precipitation method.

TABLE 5

| Emulsion No. | Br:Cl ratio | (μm) average grain size | Chemical sensitizer | | Spectral sensitizing dye (0.9 mg per mol Ag) |
|---|---|---|---|---|---|
| Em-1 | 5:95 | 0.67 | Sodium thiosulfate | — | Comparison compound BSD-1 |
| Em-2 | 5:95 | 0.67 | Sodium thiosulfate | Sodium chloro-aurate | Comparison compound BSD-1 |
| Em-3 | 5:95 | 0.67 | Sodium thiosulfate | — | Example compound I-1 |
| Em-4 | 5:95 | 0.67 | Sodium thiosulfate | Sodium chloro-aurate | Example compound I-1 |
| Em-5 | 5:95 | 0.67 | Sodium thiosulfate | Sodium chloro-aurate | Example compound I-5 |
| Em-6 | 5:95 | 0.67 | Sodium thiosulfate | Sodium chloro-aurate | Example compound I-10 |

Chemical sensitization was optimized by maintaining each silver halide emulsion at 60° C. and adding 1.5 mg thiosulfate and 3 mg sodium chloroaurate per mol silver. Then, using the spectral sensitizing dyes listed in Table 5, spectral sensitization was effected, whereby 4-hydroxy-6-methyl-1,3,3a7-tetrazaindene serving as a stabilizer was added into each emulsion at a rate of one g per mol silver halide.

Next, the following layers 1 through 7 were formed in sequence (by simultaneous coating process) on each paper support whose both surfaces had been coated with polyethylene to prepare silver halide color photographic light-sensitive material samples No. 501 through 515 (in the following examples, the amount of materials is indicated by the amount per $m^2$ lightsensitive material).

Layer 1

A layer containing, as listed in Table 6, gelatin (1.2 g), 0.29 g (silver converted value, applicable hereinunder) bluesensitive silver chloro-bromide emulsion (Em-1 to Em-6) and 2 mg of black-and white developing agent in addition, 0.3 g dinonylphthalate 9DNP) in which 0.75 g yellow coupler (example compound, Y-52), 0.3 g light-stabilizer ST-1 and 0.015 g 2,5-dioctylhydroquinone (HQ-1) having been dissolved.

Layer 2

A layer containing gelatin (0.9 g), 0.2 g DOP (dioctylphthalate) in which 0.04 g in which 0.04 g HA-1 having been dissolved, 8 mg anti-irradiation dye (AI-1) and 4 mg antiirradiation dye (AI-2).

Layer 3

A layer containing 1.25 g gelatin, 0.20 g green-sensitive silver chloro-bromide emulsion (whose Br: Cl ratio is 5:95), as well as 0.3 g DOP in which 0.62 g magenta coupler (M-1) and 0.01 g HQ-1 having been dissolved.

Layer 4

A layer containing gelatin (1.2 g), as well as 0.3 g DNP in which 0.6 g ultraviolet absorbent UV-1, below, and 0.05 g HQ-1, below having been dissolved.

Layer 5

A layer containing geletin (1.4 g), 0.20 g red-sensitive silver chloro-bromide emulsion (whose Br: Cl ratio is 5:95), as well as 0.3 g DOP in which 0.5 g cyan coupler C-1 and 0.01 g HQ-1 having been dissolved.

Layer 6

A layer containing gelatin (1.0 g) and 0.05 g 2,4-dichloro-6-hydroxyl sodium.

Comparison sensitizing dye

-continued

BSD-1

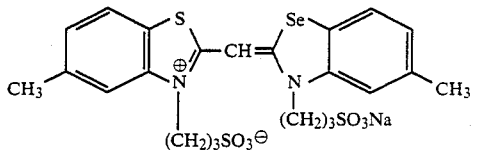

(Note-1): Green-sensitive silver chloro-bromide emulsion

Sodium thiosulfate was added into the emulsion at a rate of $3.5\times10^{-5}$ mol per mol silver halide in order to effect the chemical sensitization, whereby the optical sinsitization was effected with green sensitizing dye (GSD-1). Also, 4-hydroxy-6-methyl-1,3,3a,7-tetrazaindene compound serving as a stabilizing agent was added into the emulsion at a rate or 1.2 g per mol silver halide.

(Note-2): Red-sensitive silver chloro-bromide emulsion

Sodium thiosulfate was added into the emulsion at a rate of $3.5\times10^{-3}$ mol per mol silver halide in order to effect the chemical sensitization, whereby the optical sensitization was effected with red sensitizing dye (RSD-1). Also, 4-hydroxy-6-methyl-1,3,3a,7-tetrazaindene compound serving as a stabilizing agent was added into the emulsion at a rate of 1.2 g per mol silver halide.

(GSD-1)

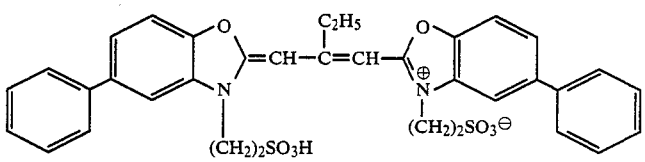

(RSD-1)

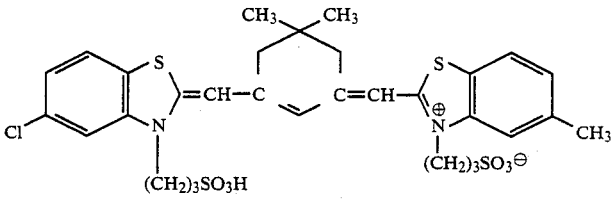

(M-1)

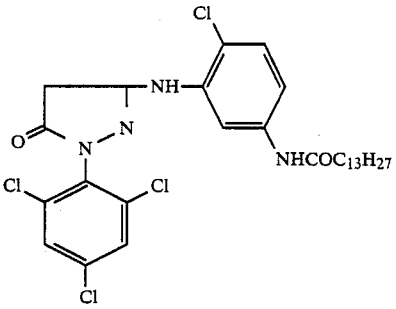

(C-1)

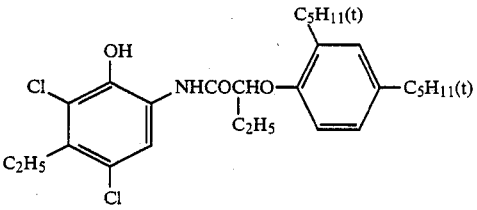

-continued

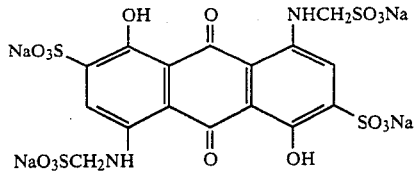

(AI-1)

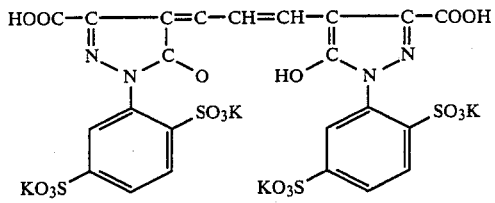

(AI-2)

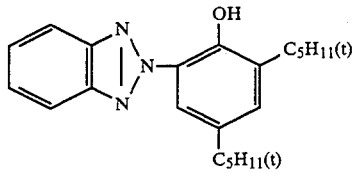

(UV-1)

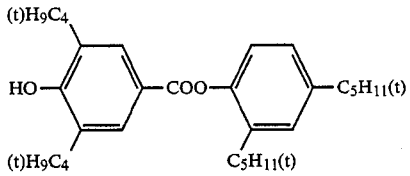

ST-1

Each of the above samples of light-sensitive materials No. 501 through 515 was exposed through the optical wedge and then treated by the following processes.

| Processing steps (35° C.) | |
|---|---|
| Color developing | 45 sec |
| Bleach-fixing | 45 sec |
| Stabilization | 1 min 30 sec |
| Drying | 60 to 80° C. 2 min |

The composition of each processing solution is as follows.

| Color developer | |
|---|---|
| Pure water | 800 ml |
| N,N—diethylhydroxylamine | 2 ml |
| Potassium chloride | 2 g |
| Potassium sulfite | 0.2 g |
| N—Ethyl-N—β-methanesulfonamidethyl-3-methyl-4-aminoaniline slufate | 5 g |
| Sodium tetrapolyphosphate | 2 g |
| Potassium carbonate | 30 g |

Pure water was added to the above ingredients to prepare one l solution, which was treated to have the pH of 10.08.

| Bleach-fixer | |
|---|---|
| Pure water | 800 ml |
| Ammonium ferric (III) ethylenediaminetetra-acetate | 65 g |
| Bisodium ethylenediaminetetraacetate | 5 g |
| Ammonium thiosulfate | 85 g |
| Sodium hydrogensulfine | 10 g |
| Sodium metabisulfite | 2 g |
| Sodium chloride | 10 g |

-continued

| Bleach-fixer | |
|---|---|
| Hydroxylamine sulfate | 2 g |

Pure water was added to the above ingredients to prepare one l solution, which was treated with dilute sulfuric acid to have the pH of 7.0.

| Stabilizer | |
|---|---|
| 5-Chloro-2-methyl-4-isothiazoline-3-one | 1 g |
| 1-Hydroxyethylidene-1,1-diphosphonic acid | 2 g |

Pure water was added to the aobe ingredients to prepare one l solution, which was treated with sulfuric acid or potassium hydroxide to have the pH of 7.0.

In addition, a color developer was prepared by adding 0.3 ml 0.6 ml of the bleach-fixer per liter of the above color developer, in Table 6, the amount of addition is presented as the amount of contaminant, and the amount in fact corresponds with the degree of how much the bleach-fixer contaminates the developer solution in practical processing, whereby the sensitometry was exercised on each of the similarly treated samples in order to determine the sensitivity, gradation, and fog of blue-sensitive emulsion layer.

The results are listed in Table 6.

The results in Table 6 show than samples No. 501 and No. 502, comparison samples, respectively containing both sulfur sensitizer and spectral sensitizing dye have low sensitivities which are not improved even with the addition of the black-and white developing agent. Apparently, samples tested after application of sensitazation, No. 503 and No. 504, or samples containing spectral sensitizing dye instead of the example compound of the invention No. 505 and No. 506, indicate larger Δγ, though having improved sensitivities, which means the enlarged performance fluctuation due to processing fluctuation. In contrast, each of the samples Nos. 508, 509, 511, 512, 514, and 515 is highly sensitive, and shows low fog ans small Δγ, and is stable to the fluctuation in processing conditions by contamination of the developer. Though respectively having emulsions Em-3, Em-4 and Em-5, each of the samples Nos. 507, 510 and 513 indicates high fog, large Δγ, when the developer is contaminated.

that the samples No. 503 through No. 507, though having high sensitivittis, significantly decreased sensitivities after the forced deterioration. In contrast, each of the samples Nos. 508, 509, 511, 512, 514 and 515 is excellent; each featuring high sensitivity, low fog, and limited sensitivity loss even after the forced deterioration. At the same time, the comparison samples Nos. 507, 510 and 153 independently show high fog, and low stability to the fluctuation in processing conditions: there is difference between a postdeterioration sample treated for 45 seconds and a similar sample treated for one minute 15 seconds.

TABLE 6

| Sample No. | Emulsion layer | Black-and-white developing agent | Sensitivity*1 | Fog*2 | Gradation*3 Amount of bleach-fixer as contaminant added into color developer 0 ml/l | 0.3 ml/l | 0.6 ml/l | Δγ*4 (0.6-0 ml/l) | Remark |
|---|---|---|---|---|---|---|---|---|---|
| 501 | Em-3 | — | 100 | 0.16 | 2.88 | 2.97 | 3.12 | 0.24 | Comparison |
| 502 | Em-3 | D-12 | 97 | 0.14 | 2.80 | 2.92 | 3.10 | 0.30 | Comparison |
| 503 | Em-4 | — | 136 | 0.23 | 2.74 | 2.91 | 3.08 | 0.34 | Comparison |
| 504 | Em-4 | D-12 | 130 | 0.20 | 2.81 | 2.99 | 3.16 | 0.35 | Comparison |
| 505 | Em-5 | — | 131 | 0.11 | 2.85 | 3.10 | 3.39 | 0.54 | Comparison |
| 506 | Em-5 | D-12 | 133 | 0.09 | 2.79 | 3.21 | 3.43 | 0.64 | Comparison |
| 507 | Em-6 | — | 158 | 0.13 | 2.82 | 3.19 | 3.41 | 0.59 | Invention |
| 508 | Em-6 | D-12 | 156 | 0.08 | 2.75 | 2.83 | 2.99 | 0.24 | Invention |
| 509 | Em-6 | D-19 | 153 | 0.07 | 2.82 | 2.93 | 3.02 | 0.20 | Invention |
| 510 | Em-7 | — | 165 | 0.10 | 2.83 | 3.02 | 3.21 | 0.48 | Invention |
| 511 | Em-7 | D-12 | 168 | 0.06 | 2.79 | 2.85 | 2.92 | 0.13 | Invention |
| 512 | Em-7 | D-19 | 166 | 0.07 | 2.70 | 2.75 | 2.86 | 0.16 | Invention |
| 513 | Em-8 | — | 172 | 0.09 | 2.80 | 3.15 | 3.40 | 0.60 | Invention |
| 514 | Em-8 | D-12 | 174 | 0.05 | 2.81 | 2.91 | 3.01 | 0.20 | Invention |
| 515 | Em-8 | D-19 | 170 | 0.05 | 2.79 | 2.86 | 2.94 | 0.15 | Invention |

*1Sensitivity is indicated as a relative sensitivity relative to the 100% sensitivity of Sample No. 501.
*2Fogging is indicated as a blue density value obtainable by subjecting an unexposed sample to color developing for 90 seconds.
*3Gradation (γ) is indicated as a tangent value taken on the density slope corresponding to the density range 0.5 to 1.5 in the sensitometry curve.
*4Δγ is indicated by the difference between the amount of contamination γ at 0.6 ml/l and the similar amount γ at 0 ml/l.

TABLE 7

| Sample No. | Same-day development Sensitivity*1 | Fogging | After forced deterioration Sensitivity | Fogging | Gradation after*2 forced deterioration 45 sec. treatment | 1 min. 15 sec. treatment | Remark |
|---|---|---|---|---|---|---|---|
| 501 | 100 | 0.17 | 64 | 0.19 | 2.75 | 2.79 | Comparison |
| 502 | 99 | 0.15 | 59 | 0.18 | 2.68 | 2.65 | Comparison |
| 503 | 134 | 0.24 | 81 | 0.32 | 2.81 | 2.73 | Comparison |
| 504 | 131 | 0.22 | 83 | 0.34 | 2.79 | 2.74 | Comparison |
| 505 | 135 | 0.13 | 89 | 0.16 | 2.34 | 2.62 | Comparison |
| 506 | 134 | 0.10 | 92 | 0.12 | 2.30 | 2.59 | Comparison |
| 507 | 152 | 0.14 | 101 | 0.21 | 2.42 | 2.81 | Comparison |
| 508 | 156 | 0.80 | 148 | 0.09 | 2.83 | 2.86 | Invention |
| 509 | 154 | 0.08 | 145 | 0.09 | 2.80 | 2.84 | Invention |
| 510 | 160 | 0.11 | 149 | 0.19 | 2.19 | 2.53 | Invention |
| 511 | 162 | 0.07 | 153 | 0.08 | 2.77 | 2.80 | Invention |
| 512 | 159 | 0.08 | 151 | 0.08 | 2.82 | 2.84 | Invention |
| 513 | 171 | 0.10 | 160 | 0.18 | 2.30 | 2.78 | Invention |
| 514 | 173 | 0.06 | 169 | 0.07 | 2.76 | 2.77 | Invention |
| 515 | 170 | 0.05 | 166 | 0.06 | 2.81 | 2.85 | Invention |

*1Sensitivity is indicated as a relative sensitivity relative to the 100% sensitivity of Sample No. 501.
*2Gradation after the forced deterioration is indicated as a tangent value taken on the density slope corresponding to the density range 0.5 to 1.5 in the sensitometry curve.

EXAMPLE 6

Samples in the aobe Example 5 were allowed to stand for five days under the confitions of 50° C. and 70% RH for forced deterrioration. With each sample, the treatment identical to that of Example 5, except that the developing time was modified to 45 seconds or one minute 15 seconds instead of the contamination test, so as to assess the shelf life of each sample. The results are listed in Table 7.

The results in Table 7 illustrate that the samples No. 501 and No. 502 comparison samples, show significantly decreased sensitivities after the forced dterioration, and

EXAMPLE 7

By the preparation method identical to that of Example 1, silver halide emulsions Em-9 through Em-11 each having silver halide grains and spectral sensitizing dye listed in Table 8 were prepared.

TABLE 8

| Emulsion No. | Br:Cl ratio | (μm) average grain size | Chemical sensitizer | | Spectral sensitizing dye (0.9 mmol per mol Ag) |
|---|---|---|---|---|---|
| Em-9 | 1:99 | 0.71 | Sodium thiosulfate | Sodium chloroaurate | I-2 |
| Em-10 | 1:99 | 0.71 | Sodium thiosulfate | Sodium chloroaurate | I-6 |
| Em-11 | 1:99 | 0.71 | Sodium thiosulfate | Sodium chloroaurate | I-18 |

Using these emulsions, and by replacing yellow coupler in the layer constitution of Example 5 with example yellow coupler Y-53, as well as by replacing the black-and white developing agent in Example 5 with the compound listed in Table 9, silver halide color photographic light-sensitive materials were prepared.

With the obtained samples, a test identical to that of Example 5 was exercised. The test results are listed in Table 9. As the comparison samples, samples No. 505 and No. 506 in Example 5 were used, in Table 9, they are listed as samples No. 716 and No. 717.

Table 9 illustrate this example also can provide the results similar to those of Example 5.

With the samples No. 716 through No. 719 of this example, a test identical to that of Example 6 was exercised, and the results similar to those of Example 6 were obtained.

TABLE 9

| Sample No. | Emulsion layer | Black-and-white developing agent | Sensitivity*2 | Fog*3 | Gradation Amount of bleach-fixer added as contaminant into color developer 0 ml/l | 0.3 ml/l | 0.6 ml/l | Δγ*4 (0.6–0 ml/l) | Remark |
|---|---|---|---|---|---|---|---|---|---|
| 716*1 | Em-3 | — | 100 | 0.12 | 2.80 | 3.12 | 3.41 | 0.61 | Comparison |
| 717*1 | Em-3 | D-12 | 97 | 0.11 | 2.77 | 3.08 | 3.35 | 0.58 | Comparison |
| 718 | Em-7 | — | 128 | 0.10 | 2.83 | 3.15 | 3.39 | 0.56 | Comparison |
| 719 | Em-7 | D-8 | 130 | 0.06 | 2.79 | 2.88 | 2.96 | 0.17 | Invention |
| 720 | Em-7 | D-15 | 127 | 0.07 | 2.81 | 2.89 | 2.99 | 0.18 | Invention |
| 721 | Em-7 | D-20 | 130 | 0.06 | 2.84 | 2.93 | 3.05 | 0.21 | Invention |
| 722 | Em-8 | — | 140 | 0.12 | 2.75 | 3.10 | 3.36 | 0.61 | Invention |
| 723 | Em-8 | D-8 | 138 | 0.05 | 2.71 | 2.78 | 2.92 | 0.21 | Invention |
| 724 | Em-8 | D-15 | 135 | 0.06 | 2.73 | 2.80 | 2.88 | 0.15 | Invention |
| 725 | Em-8 | D-20 | 136 | 0.06 | 2.69 | 2.79 | 2.85 | 0.16 | Invention |
| 726 | Em-9 | — | 131 | 0.10 | 2.76 | 3.04 | 3.35 | 0.59 | Invention |
| 727 | Em-9 | D-8 | 132 | 0.08 | 2.73 | 2.82 | 2.87 | 0.14 | Invention |
| 728 | Em-9 | D-15 | 132 | 0.07 | 2.79 | 2.89 | 3.00 | 0.21 | Invention |
| 729 | Em-9 | D-20 | 129 | 0.07 | 2.77 | 2.86 | 2.96 | 0.19 | Invention |

*1Samples No. 716 and No. 717 are respectively same as samples No. 505 and No. 506 prepared in Example 5.
*2, 3, 4Same as those of Example 5.

EXAMPLE 8

With the samples of Example 7, a bleach-fixer contamination test identical to that of Example 5, as well as a forced deterioration identical to that of Example 6 were exercised, whereby the sensitivity and gradation fluctuation were measured with each of the samples. The measured results were compared with the sensitometric values of other green-sensitive layers and red-sensitive layers. As a result, it was learned that in the samples containing the black-and-white developing agent various fluctuation factors were improved, the sensitivity and gradation of the blue sensitive layer well matches those of the other layers.

EXAMPLE 9

As shown in Table 6, two samples were prepared in the same manner as that used in Example 5 except that the black-and-white agent was replaced. One sample was developed immediately after being prepared, and the other was stored for 5 days under the conditions of 50° C. and 70% RH, then exposed and developed. The effect of the present invention that the characteristic fluctuation after being forcedly deteriorated was small was proved as shown in Table 10. In addition, it was also proved that hydroxybenzen derivatives were effective to suppress fogging.

TABLE 10

| Sample No. | Em | Black-and-white developing agent | Stored for 5 days in 50° C., 70 RH. Sensitivity | Fogging | Sensitivity | Fogging | |
|---|---|---|---|---|---|---|---|
| 901 | Em-3 | — | 100 | 0.16 | 64 | 0.19 | Comparison |
| 902 | Em-3 | D-12 | 97 | 0.15 | 59 | 0.18 | Comparison |
| 903 | Em-11 | — | 130 | 0.10 | 92 | 0.22 | Present invention |
| 904 | Em-11 | D-1 | 135 | 0.11 | 121 | 0.14 | Present invention |
| 905 | Em-11 | D-8 | 124 | 0.10 | 118 | 0.12 | Present invention |
| 906 | Em-11 | D-12 | 127 | 0.10 | 119 | 0.12 | Present invention |
| 907 | Em-11 | D-19 | 132 | 0.09 | 125 | 0.10 | Present invention |
| 908 | Em-11 | D-21 | 133 | 0.09 | 122 | 0.09 | Present invention |

EXAMPLE 10

Into a strongly stirred gelatin solution, 0.5 l of silver nitrate solution of 2 mol/liter and 0.5 l of sodium chloride solution of 2 mol/liter were added over a period of 150 min., thus obtaining a pure silver chloride emulsion Em-12. While the adding operation, the solution temperature was maintained at 60° C., and PAg at 6.0. An electron microscope observation revealed that the average grain size of the obtained emulsion was 0.65 microns and crystalline shape was cubic.

By replacing the sodium chloride solution with a mixed silver halide solution containing 0.995 mol of sodium chloride and 0.005 mol of potassium bromide, silver chlolo-bromide emulsion Em-13 containing 0.5 mol of silver bromide was prepared using the same manner as that of Em-12. The average grain size of the obtained emulsion was 0.65 microns and crystalline shape was cubic.

By replacing the sodium chloride solution with a mixed silver halide solution containing 0.975 mol of sodium chloride and 0.025 mol of potassium bromide, silver chlolo-bromide emulsion Em-12 containing 2.5 mol of silver bromide was prepared using the same manner as that of Em-14. The average grain size of the obtained emulsion was 0.65 microns and crystalline shape was cubic.

As a sulfur sensitizing agent, sodium thiosulfate was added into the emulsions Em-12 through Em-14 by $1\times10^{-5}$ mol per silver halide of 1 mol, further $2\times10^{-5}$ mol of chloroauric acid was added, then the obtained solution was chemically ripened. The sensitizing dye I-22 shown above was added 5 min. before the end of the ripening process by $10^{-4}$ mol per 1 mol of silver halide, stabilizer ST-1 was added at the end of the ripening process by $10^{-3}$ mol per 1 mol of silver halide, thus blue-sensitive silver halide emulsion was prepared.

Yellow coupler Y-44 shown above, and anti-stain agent HQ-1 of 0.15 mol per 1 mol of the yellow coupler, both which were dispersed in dibutylphthalate (hereinafter referred to as DBP) were mixed into the blue-sensitive silver halide emulsion so that the 0.3 mol of the coupler was obtained per 1 mol of silver halide. The coating solution prepared thus was applied onto photographic support coated wth polyethylene containing titanium oxide. Further, protective layer was applied onto the support, thereby obtaining samples. The quantity of silver halide or gelatin contained in each layer applied was adjusted so that 0.4 g/m$^2$ of metallic silver was obtained and 3.0 g/m$^2$ of gelatin in the emulsion layer and 1 g/m$^2$ of gelatin in the protective layer.

Each sample prepared thus was subjected to the light intensity scale exposure and to the following processes.

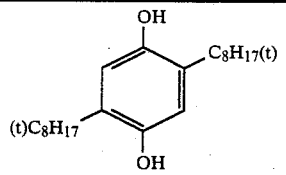

HQ-1

| (Processing step) | | |
|---|---|---|
| Color developing | 35° C. | 45 sec. |
| Bleach-fixing | 35° C. | 45 sec. |
| Water rinsing | 30 to 35° C. | 90 sec. |
| Drying | 60 to 68° C. | 60 sec. |

The composition of the color developer and bleach-fixer used were as follows (Quantity per one lifter solution is listed.):

| (Color developer) | |
|---|---|
| Pure water | 800 ml |
| Triethanolamine | 12 ml |
| N,N—diethylhydroxylamine (85% solution) | 12 ml |
| Potassium chloride | 2.2 g |
| Potassium sulfite | 0.2 g |
| N—ethyl-N—β-methanesulfonamidethyl-3-methyl-4-aminoaniline sulfate | 5.0 g |
| 1-Hydroxyethylidene-1-1-diphosphonate(-ERROR-) lenediamine tetraacetic acid | 2 g |

-continued

| (Color developer) | |
|---|---|
| Soluble fluorescent whitening agent of diaminostilbene system | 2 g |

Pure water was added to the above mixture to obtain a one liter solution, which was adjusted at pH 10.1.

| (Bleach-fixer) | |
|---|---|
| Pure water | 800 ml |
| Ammonium ferric (III) ethylenediaminetetraacetate | 65 g |
| Bisodium ethylenediaminetetraacetate | 5 g |
| Ammonium thiosulfate | 85 g |
| Sodium hydrogensulfine | 10 g |
| Sodium metabissulfite | 2 g |
| Sodium chloride | 10 g |
| N,N—diethylhydroxylamine (85% solution) | 2 ml |

Pure water was added to the above mixture to obtain a one liter solution, which was adjusted as pH 6.5 using dilute sulfuric acid.

The reflection density of obtained dye images was measured using a PDA-65 densitometer (manufactured by Konishiroku Photo Industry Co., Ltd.) and using monochromatic blue light, thereby obtaining the results listed in Table 11.

In this table, the sensitivity is represented by a reciprocal of exposure quantity which gives density of 1.0, at the same time, by a relative value relative to the 100% sensitivity of Sample 1001.

TABLE 11

| No. | Emulsion* | Sensitivity | Minimum density | Maximum density |
|---|---|---|---|---|
| 1001 | Em-12 | 100 | 0.08 | 2.60 |
| 1002 | Em-13 | 132 | 0.06 | 2.58 |
| 1003 | Em-14 | 85 | 0.09 | 2.53 |

*Blue-sensitive silver halide emulsion was used.

Sample 1002, which employed the silver halide emulsion Em-13 containing 0.5% mol of silver bromide, was of high-sensitive and low in the minimum density, and its maximum density was equivalent to that of the Em-12. On the contrary, the maximum density of Sample 1003, which used the silver halide emulsion Em-14 containing slightly more silver bromide, slightly deteriorates, its sensitivity obtained after chemical ripening step is lower than that of the Em-12, and its minimum density is a little higher than that of the Em-12. Example 11

Em-15 and Em-16 were prepared by changing preparation amount of silver halide to 10 mol and 1000 mol in the same manner as that used for the Em-12 in Example 10. Next, Em-17 and Em-18 were prepared by changing preparation amount of silver halide to 10 mol and 1000 mol in the same manner as that used for the Em-13. The average grain size of each emulsion was 0.65 microns and crystalline shape was cubic.

In the emulsion preparing method used in Example 10, potassium bromide solution of 2 mol/l was added by 0.0025 l instead of sodium chloride solution of 2 mol/l after adding 0.4975 l of silver nitrate solution, thereby obtaining silver chloro-bromide emulsion Em-19. Em-20 and Em-21 were prepared by changing preparation amount of silver halide to 10 mol and 1000 mol in the same manner as that used above. The average grain size of the emulsion was 0.65 microns and crystalline shape was cubic. Each emulsion from Em-15 through Em-21 thus prepared was subjected to the chemical ripening, application, and characteristic evaluation steps in the same manner as that used in Example 10, thus the results listed in Table 12 were obtained.

The sensitivity of each sample is represented by a relative value relative to the 100% of Sample 1101.

TABLE 12

| No. | Silver halide emulsion | Sensitivity | Minimum density | Maximum density |
|---|---|---|---|---|
| 1101 | Em-12 | 100 | 0.09 | 2.62 |
| 1102 | Em-15 | 87 | 0.12 | 2.63 |
| 1103 | Em-16 | 97 | 0.10 | 2.63 |
| 1104 | Em-13 | 130 | 0.06 | 2.59 |
| 1105 | Em-17 | 135 | 0.07 | 2.57 |
| 1106 | Em-18 | 138 | 0.06 | 2.60 |
| 1107 | Em-19 | 154 | 0.06 | 2.58 |
| 1108 | Em-20 | 162 | 0.06 | 2.56 |
| 1109 | Em-21 | 169 | 0.07 | 2.57 |

Each silver halide emulsion obtained by preparation amount scale of 1 mol, 10 oml, and 1000 mol was exactly equivalent under the observation with an electron microscope, respectively. However, evaluation of photogrpahic characteristics of each emulsion after chemical ripening step revealed that the sensitivity fluctuation of Em-13, 17, 18, 19, and 20, whose contents of silver halide were within a range from 99.0 mol% through 99.5 mol%, was only approximately 3 through 4%. On the contrary, Em-12, 15, and 16 showed a sensitivity fluctuation of approximately 6% and an increase in the minimum density.

A high sensitivity and a low minimum density in a silver halide color photographic light-sensitive material using an emulsion containing silver chloride from 99.0 to 99.5 mol% were reproduced in all samples irrespective of manufacturing lot.

It is preferable that silver bromide, which is slightly effective in order to stabilize the photographic characteristics, is uniformly dispersed in the grain in an emulsion, in which silver bromide was formed at the final step for preparing the silver halide grain.

EXAMPLE 12

Samples were prepared in the same manner as used in Example 10 except that sensitizing dyes were replaced with the compounds listed in Table 13, and were subjected to the characteristic evaluation. The sensitivity of each sample is represented by a relative value relative to the 100% of Sample 1201.

TABLE 13

| No. | Silver halide emulsion | Sensitizing dye | Sensitivity | Minimum density | Maximum density |
|---|---|---|---|---|---|
| 1201 | Em-12 | I-22 | 100 | 0.08 | 2.63 |
| 1202 | Em-12 | I-32 | 124 | 0.08 | 2.65 |
| 1203 | Em-12 | I-45 | 120 | 0.06 | 2.64 |
| 1204 | Em-12 | I-47 | 116 | 0.07 | 2.64 |
| 1205 | Em-12 | I-49 | 92 | 0.10 | 2.63 |
| 1206 | Em-13 | I-22 | 133 | 0.07 | 2.60 |
| 1207 | Em-13 | I-32 | 156 | 0.06 | 2.59 |
| 1208 | Em-13 | I-45 | 160 | 0.06 | 2.61 |
| 1209 | Em-13 | I-47 | 145 | 0.05 | 2.60 |
| 1210 | Em-13 | I-48 | 100 | 0.08 | 2.59 |
| 1211 | Em-12 | I-27 | 98 | 0.07 | 2.63 |
| 1212 | Em-15 | I-27 | 93 | 0.07 | 2.63 |
| 1213 | Em-16 | I-27 | 107 | 0.06 | 2.62 |
| 1214 | Em-12 | I-34 | 116 | 0.05 | 2.61 |
| 1215 | Em-15 | I-34 | 107 | 0.06 | 2.60 |
| 1216 | Em-16 | I-34 | 113 | 0.05 | 2.60 |

TABLE 13-continued

| No. | Silver halide emulsion | Sensitizing dye | Sensitivity | Minimum density | Maximum density |
|---|---|---|---|---|---|
| 1217 | Em-13 | I-27 | 125 | 0.07 | 2.60 |
| 1218 | Em-17 | I-27 | 121 | 0.09 | 2.59 |
| 1219 | Em-18 | I-27 | 122 | 0.08 | 2.59 |
| 1220 | Em-13 | I-34 | 141 | 0.06 | 2.60 |
| 1221 | Em-17 | I-34 | 138 | 0.06 | 2.58 |
| 1222 | Em-18 | I-34 | 140 | 0.06 | 2.57 |
| 1223 | Em-12 | Comparison dye A | 82 | 0.11 | 2.62 |
| 1224 | Em-15 | Comparison dye A | 85 | 0.11 | 2.61 |
| 1225 | Em-16 | Comparison dye A | 80 | 0.11 | 2.62 |
| 1226 | Em-13 | Comparison dye A | 98 | 0.10 | 2.59 |
| 1227 | Em-17 | Comparison dye A | 100 | 0.09 | 2.59 |
| 1228 | Em-18 | Comparison dye A | 102 | 0.11 | 2.61 |
| 1229 | Em-12 | Comparison dye B | 71 | 0.13 | 2.63 |
| 1230 | Em-15 | Comparison dye B | 73 | 0.11 | 2.64 |
| 1231 | Em-16 | Comparison dye B | 76 | 0.10 | 2.63 |
| 1232 | Em-13 | Comparison dye B | 88 | 0.12 | 2.58 |
| 1233 | Em-17 | Comparison dye B | 91 | 0.13 | 2.59 |
| 1234 | Em-18 | Comparison dye B | 86 | 0.13 | 2.58 |
| 1235 | Em-12 | Comparison dye C | 118 | 0.07 | 2.63 |
| 1236 | Em-15 | Comparison dye C | 110 | 0.07 | 2.63 |
| 1237 | Em-16 | Comparison dye C | 123 | 0.08 | 2.62 |
| 1238 | Em-13 | Comparison dye C | 142 | 0.07 | 2.61 |
| 1239 | Em-17 | Comparison dye C | 133 | 0.07 | 2.60 |
| 1240 | Em-18 | Comparison dye C | 154 | 0.07 | 2.59 |
| 1241 | Em-12 | Comparison dye D | 64 | 0.09 | 2.60 |
| 1242 | Em-15 | Comparison dye D | 61 | 0.10 | 2.60 |
| 1243 | Em-16 | Comparison dye D | 69 | 0.09 | 2.61 |
| 1244 | Em-13 | Comparison dye D | 78 | 0.10 | 2.59 |
| 1245 | Em-17 | Comparison dye D | 74 | 0.10 | 2.60 |
| 1246 | Em-18 | Comparison dye D | 86 | 0.09 | 2.61 |
| 1247 | Em-12 | Comparison dye E | 130 | 0.08 | 2.59 |
| 1248 | Em-15 | Comparison dye E | 128 | 0.08 | 2.58 |
| 1249 | Em-16 | Comparison dye E | 141 | 0.07 | 2.59 |
| 1250 | Em-13 | Comparison dye E | 153 | 0.06 | 2.60 |
| 1251 | Em-17 | Comparison dye E | 140 | 0.07 | 2.61 |
| 1252 | Em-18 | Comparison dye E | 168 | 0.07 | 2.60 |

The results shown in the table above reveal that the sensitizing dyes according to the present invention ensure a high sensitivity and a low minimum density by being combined with a silver halide emulsion containing a high content of chloride. Especially, dyes such as I-27, I-34, I-45, and I-47, which contain an alkyl radical substituted with a sulfo radical and an alkyl radical substituted with a carboxyl radical, showed a low minimum density, tehreby being used preferably.

When the sensitizing dye according to the present invention is combined with the pure silver chloride emulsion Em-12, 15 or 16, the fluctuation in sensitivity caused by the preparation scale of the slver halide emulsion is apt to be larger than that when the comparison dye A or B is used. However, when the silver halide emulsion containing silver chloride from 99.0 through 99.5 mol% is used, the fluctuation is improved to the same level as that of the comparison dye A or B. In addition, the features of a high sensitivity and a low minimum density are not lost.

When the comparison dye C, D, or E having a naphthothiazole nucleus is used, a high sensitivity is obtained by the comparison dye C or E. However, the fluctuation in sensitivity caused by the preparation scale of the silver halide emulsion cannot be improved by combining Em-13, 17, or 18, which contain silver bromide by 0.5 mol%. Moreover, when the comparison dye D is used, the sensitivity is low and the fluctuation in sensitivity cannot be improved.

Comparison dye A

-continued

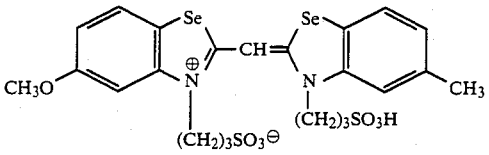

Comparison dye B

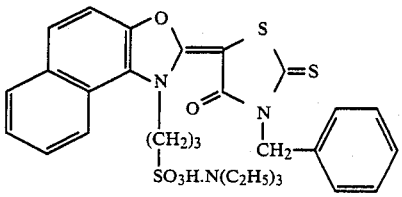

Comparison dye C

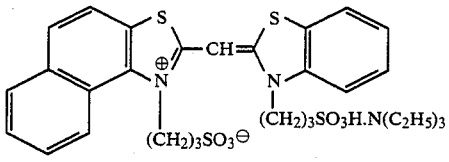

Comparison dye D

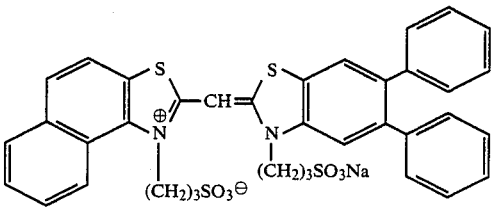

Comparison dye E

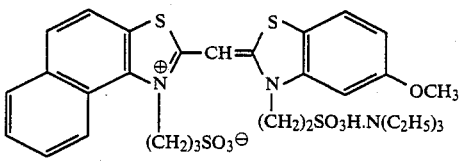

EXAMPLE 13

Samples were prepared in the same manner as that used in Example 10 except that only sodium thiosulfate was added as the sensitizing agent, and were subjected to the characteristic evaluation. The sensitivity of each sample is represented by a relative value relative to the 100% of Sample 1301.

TABLE 14

| No. | Silver halide emulsion | Chloroauric acid | Sensitivity | Minimum density | Maximum density |
|---|---|---|---|---|---|
| 1301 | Em-12 | Added | 100 | 0.13 | 2.62 |
| 1302 | Em-15 | Added | 90 | 0.12 | 2.61 |

TABLE 14-continued

| No. | Silver halide emulsion | Chloroauric acid | Sensitivity | Minimum density | Maximum density |
|---|---|---|---|---|---|
| 1303 | Em-16 | Added | 94 | 0.13 | 2.63 |
| 1304 | Em-12 | Not added | 64 | 0.10 | 2.60 |
| 1305 | Em-15 | Not added | 81 | 0.12 | 2.59 |
| 1306 | Em-16 | Not added | 85 | 0.10 | 2.59 |
| 1307 | Em-13 | Added | 139 | 0.06 | 2.59 |
| 1308 | Em-17 | Added | 135 | 0.07 | 2.57 |
| 1309 | Em-18 | Added | 131 | 0.06 | 2.59 |
| 1310 | Em-13 | Not added | 109 | 0.07 | 2.57 |
| 1311 | Em-17 | Not added | 99 | 0.07 | 2.55 |
| 1312 | Em-18 | Not added | 102 | 0.08 | 2.56 |

The emulsion sensitized only by sulfur showed a low sensitivity and a large characteristic fluctuation, however, the sensitivity of emulsions is significantly improved and the characteristics are significantly stabilizing by sensitizing with gold at the same time.

EXAMPLE 14

Silver chloride emulsion Em-22 and silver chlorobromide emulsion Em-23 both having a grain size of 0.4 microns were prepared according to the preparation method used for Em-12 and Em-13 in Example 10. Into these emulsions, sodium thiosulfate was added as sulfur sensitizing agent, and chloroauric acid was further added, then each emulsion was subjected to the chemical ripening step, and divided into two parts. Into one part, sensitizing dye GS-1 was added, and into the other, RS-1 was added. Five min. after, stabilizing agent ST-1 was added into both emulsions terminating the chemical ripening step.

Thus, green-sensitive emulsion containing GS-1 and red-sensitive emulsion containing RS-1 were prepared.

Next, the following seven layers were applied and laminated in sequence onto polyethylene coated paper support, thereby silver halide color photographic light-sensitive material was obtained. The quantity of each chemical compound is represented in weight per 1 $m^2$ of color photographic light-sensitive material in the following description.

(First layer)

Silver halide emulsion layer containing 0.4 g of dibutylphthalate dispersion, into which 0.85 g of yellow couper Y-44 and 0.015 g of anti-stain agent HQ-1 have been dissolved, blue-sensitive emulsion by a quantity equivalent to 0.4 g of silver, and 2 g of gelatin.

(Second layer)

Intermediate layer containing 0.03 g of dibutylphthalate dispersion, into which 0.03 g of anti-stain agent HQ-1 has been dissolved, and 1 g of gelatin.

(Third layer)

Silver halide emulsion layer containing 0.34 g of tricresylphosphate dispersion, into which 0.63 g of magenta coupler MC-1 (described below) and 0.015 g of anti-stain agent HQ-1 have been dissolved, green-sensitive emulsion by a quantity equivalent to 0.4 g of silver, and 2 g of gelatin.

(Fourth layer)

Intermediate layer containing 0.5 g of dibutylphthalate dispersion, into which 0.03 g of anti-stain agent HQ-1 and 0.8 g of ultraviolet absorbing agent (described below) have been dissolved, and 0.15 g of gelatin.

(Fifth layer)

Silver halide emulsion layer containing 0.2 g of dioctylphthalate dispersion, into which 0.35 g of cyan coupler CC-1 and 0.015 g of anti-stain agent HQ-1 have been dissolved, red-sensitive emulsion by a quantity equivalent to 0.30 g of silver, and 1.5 g of gelatin.

(Sixth layer)

Intermediate layer containig 0.3 g of dibutylphthalate dispersion, into which 0.4 g of ultraviolet absorbing agent has been dissolved, and 1 g of gelatin.

(Seventh layer)

Layer containing 1 g of gelatin.

TABLE 15

| No. | Blue-sensitive emulsion | Green-sensitive emulsion | Red-sensitive emulsion |
|---|---|---|---|
| 1401 | Em-12 | Em-22 | Em-22 |
| 1402 | Em-15 | Em-22 | Em-22 |
| 1403 | Em-16 | Em-22 | Em-22 |
| 1404 | Em-13 | Em-23 | Em-23 |
| 1405 | Em-17 | Em-23 | Em-23 |
| 1406 | Em-18 | Em-23 | Em-23 |

CC-1

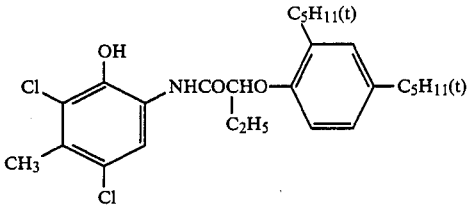

MC-1

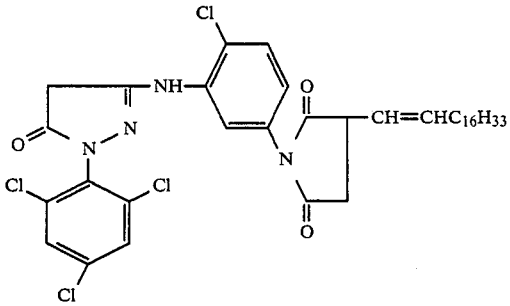

Ultraviolet absorbing agent

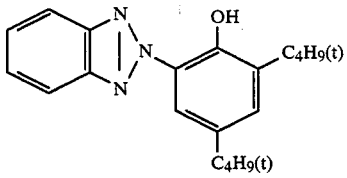

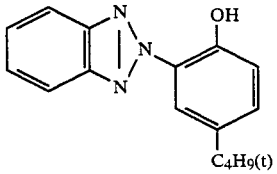

-continued

Mixture prepared at a ratio of 2:3

The color paper thus prepared was subjected to an exposure process through a color negative and to the color developing process used in Example 10. The exposure conditions were adjusted so that an optimum result was obtained for Sample 1401 or 1404. The exposure condition adjusted for Sample 1401 was applied for Samples 1405 and 1404, and the condition adjusted for Sample 1404 was applied for Samples 1405 and 1406. Color prints of Samples 1405 and 1406 equivalent to those of Samples 1401 and 1404 were obtained, however, the obtained color print of Sample 1402 was blueish.

Thus, the characteristic fluctuation caused by manufacturing lot of silver halide photographic light-sensitive materials using emulsions containing silver chloride from 99.0 through 99.5 mol% was limited to a very small value, thus permitting to obtain color prints without substantially changing the color developing conditions.

What is claimed is:

1. A silver halide color photographic light-sensitive material comprising a support having thereon photographic component layers including at least one silver halide emulsion layer comprising (a) silver halide grains comprising not less than 80 mol% of silver chloride, (b) a gold compound in an amount of from $5\times10^{-7}$ to $5\times10^{-3}$ mol per mol of silver halide contained in said silver halide emulsion layer, (c) a sulfur sensitizer and (d) a spectral sensitizing dye represinted by the following general formul [I] in an amount of from $5=10^{-6}$ to $3\times10^{-3}$ mol per mol of silver halide containing said silver halide emulsion layer:

General formula [I]

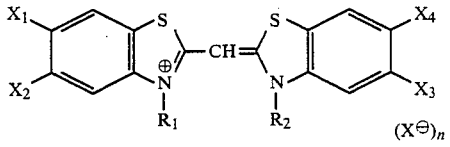

wherein $X_1$, $X_2$, $X_3$ and $X_4$ hydrogen atom, a halogen atom, an alkyl group, an alkoxy group, an aryl group or a hydroxy group, respectively; $R_1$ and $R_2$ are an alkyl group, respectively; $X^{\ominus}$ is a counter anion and n is 0 or 1.

2. The silver halide color photographic light-sensitive material of claim 1, wherein at least one of said photographic component layers contains a black-and-white developing agent.

3. The silver halide color photographic light-sensitive material of claim 2, wherein said silver halide emulsion layer contains an yellow coupler represented by the following general formula:

General formula [Y]

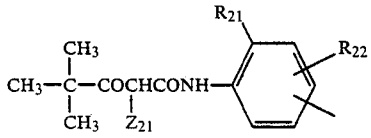

wherein $R_{21}$ is a halogen atom or an alkoxy group; $R_{22}$ is a $—NHCOR_{23}SO_2R_{24}$ group, a $—COOR_{24}$ group, a $—COOR_{23}COOR_{24}$ group, an $$—\underset{\underset{R_{25}}{|}}{N}SO_2R_{24}$$

group or an $$—SO_2\underset{\underset{R_{25}}{|}}{N}R_{24}$$

group in which $R_{23}$ is an alkylene group, $R_{24}$ is a ballast group and $R_{25}$ is an alkyl group, an aralkyl group or a hydrogen atom; and $Z_{21}$ is a group capable of being splitted off upon reaction with the oxidized product of a color developing agent.

4. The silver halide color photographic light-sensitive material of claim 2, wherein the whole of silver halide emulsion layers included said photographic component layers contain silver halide grains comprising not less than 80 mol% of silver chloride.

5. The silver halide color photograhic light-sensitive material of claim 2, wherein average silver chloride content of silver halide grains contained in each silver halide emulsion layer included said photographic component layers is not less than 95 mol%, respectively.

6. The silver halide color photographic light-sensitive material of claim 2, wherein $R_1$ and $R_2$ of the general formula [I] are an unsubstituted alkyl group or an alkyl group substituted with a carboxy group or a sulfo group, respectively.

7. The silver halide color photographic light-sensitive material of claim 2, wherein $R_1$ and $R_2$ of the general formula [I] are an alkyl group substituted with a carboxy group or a sulfo group, respectively.

8. The silver halide color photographic light-sensitive material of claim 2, wherein at least one of the groups represented by $R_1$ and $R_2$ of the general formula [I] is an alkyl group substituted with a carboxy group.

9. The silver halide color photographic light-sensitive material of claim 1, wherein said silver halide emulsion layer contains an yellow coupler represented by the following general formula [Y]:

General formula [Y]

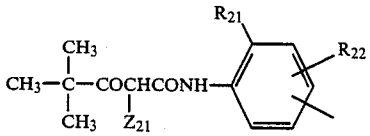

wherein $R_{21}$ is a halogen atom or an alkoxy group; $R_{22}$ is a $—NHCOR_{23}SO_2R_{24}$ group, a $—COOR_{24}$ group, a $—COOR_{23}COOR_{24}$ group, an $$—\underset{\underset{R_{25}}{|}}{N}SO_2R_{24}$$

group or an $$—SO_2\underset{\underset{R_{25}}{|}}{N}R_{24}$$

group in which $R_{23}$ is an alkylene group, $R_{24}$ is a ballast group and $R_{25}$ is an alkyl group, an aralkyl group or a hydrogen atom; and $Z_{21}$ is a group capable of being splitted off upon reaction with the oxydized product of a color developing agent.

10. The silver halide color photographic light-sensitive material of claim 1, wherein the whole of silver halide emulsion layers included said photographic component layers contain silver halide grains comprising not less than 80 mol% of silver chloride.

11. The silver halide color photographic light-sensitive material of claim 1, wherein average silver chloride content of silver halide grains contained in each silver halide emulsion layer included said photographic component layers is not less than 95 mol%, respectively.

12. The silver halide color photographic light-sensitive material of claim 2, wherein said black-and white developing agent is a dihydroxybenzene.

13. The silver halide color photographic light-sensitive material of claim 1, wherein $R_1$ and $R_2$ of the general formula [I] are an unsubstituted alkyl group or an alkyl group substituted with a carboxy group or a sulfo group, respectively.

14. The silver halide color photographic light-sensitive material of claim 1, wherein $R_1$ and $R_2$ of the general formula [I] are an alkyl group substituted with a carboxy group or a sulfo group, respectively.

15. The silver halide color photographic light-sensitive material of claim 1, wherein at least one of the groups represented by $R_1$ and $R_2$ of the general formula [I] is an alkyl group substituted with a carboxy group.

16. A silver halide color photographic light-sensitive material comprising a support having thereon photographic component layers including at least one silver halide emulsion layer comprising, (a) silver halide grains comprising from 99.0 to 99.9 mol% of silver chloride and being sensitized with gold compound, (b) a spectral sensitizing dye represented by the following general formula [I]:

General formula [I]

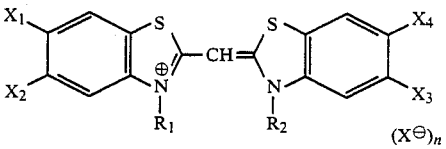

wherein $X_1$, $X_2$, $X_3$ and $X_4$ are a hydrogen atom, a halogen atom, an alkyl group, an alkoxy group, an aryl group or a hydroxy group, respectively; $R_1$ and $R_2$ are an alkyl group, respectively; $X^{\ominus}$ is a counter anion and n is 0 or 1 and (c) a sulfur sensitizer.

17. The silver halide color photographic light-sensitive material of claim 16, wherein said silver halide grains are sensitized with a gold compound in an amount of from $5\times10^{-7}$ to $5\times10^{-4}$ mol per mol of silver halide.

18. The silver halide color photographic light-sensitive material of claim 16, wherein said groups represented by $R_1$ and $R_2$ of the general formula [I] are an unsubstituted alkyl group or an alkyl group substituted with a carboxy group or a sulfo group, respectively.

19. The silver halide color photographic light-sensitive material of claim 16, wherein at least one of said groups represented by $R_1$ and $R_2$ of the general formula [I] is an alkyl group substituted with a carboxy group or a sulfo group.

20. The silver halide color photographic light-sensitive material of claim 16, wherein at least one of said groups $R_1$ and $R_2$ of the general formula [I] is an alkyl group substituted with a carboxy group.

21. The silver halide color photographic light-sensitive material of claim 16, wherein said silver halide grains are sensitized by said gold compound in an amount of from $5\times10^{-6}$ to $3\times10^{-3}$ mol per mol of silver halide containing said silver halide emulsion layer.

* * * * *